US006288697B1

(12) United States Patent
Eto et al.

(10) Patent No.: US 6,288,697 B1
(45) Date of Patent: Sep. 11, 2001

(54) METHOD AND CIRCUIT FOR DRIVING DISPLAY DEVICE

(75) Inventors: Sunao Eto, Tenri; Hisao Okada, Ikoma-gun, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 08/969,447

(22) Filed: Nov. 13, 1997

(30) Foreign Application Priority Data

Nov. 15, 1996 (JP) ..... 8-305360

(51) Int. Cl.[7] ..... G09G 3/36
(52) U.S. Cl. ..... 345/87; 345/94
(58) Field of Search ..... 345/87, 98, 100, 345/95, 97, 99, 212, 213, 94

(56) References Cited

U.S. PATENT DOCUMENTS

| | | | | |
|---|---|---|---|---|
| 4,301,466 | * | 11/1981 | Lemoine et al. | 358/13 |
| 4,694,349 | * | 9/1987 | Takeda et al. | 358/241 |
| 4,750,039 | * | 6/1988 | Willis | 358/183 |
| 4,804,951 | * | 2/1989 | Yamashita et al. | 340/719 |
| 4,985,770 | * | 1/1991 | Nagashima et al. | 358/152 |
| 5,057,928 | * | 10/1991 | Nagashima et al. | 338/236 |
| 5,093,655 | * | 3/1992 | Tanioka et al. | 340/784 |
| 5,170,158 | * | 12/1992 | Shinya | 340/800 |
| 5,206,635 | * | 4/1993 | Inukuza et al. | 340/784 |
| 5,287,100 | * | 2/1994 | Guttag et al. | 345/213 |
| 5,402,142 | | 3/1995 | Okada et al. . | |
| 5,598,178 | * | 1/1997 | Kawamori | 345/93 |
| 5,764,212 | * | 6/1998 | Nishitani et al. | 345/98 |
| 5,838,337 | * | 11/1998 | Kimura et al. | 345/519 |
| 5,856,816 | * | 1/1999 | Youn | 345/98 |
| 5,877,740 | * | 3/1999 | Hirakata et al. | 345/103 |
| 5,923,320 | * | 7/1999 | Murakami et al. | 345/179 |

FOREIGN PATENT DOCUMENTS

| | | |
|---|---|---|
| 0181598 | 5/1986 | (EP) . |
| 0241562 | 10/1987 | (EP) . |
| 0323260 | 7/1989 | (EP) . |
| 0755044 A1 | 7/1996 | (EP) . |
| 63-48077 | 9/1988 | (JP) . |
| 2-74444 | 2/1990 | (JP) . |
| 553534 | 3/1993 | (JP) . |

OTHER PUBLICATIONS

Ito et al, "21.3:10.4–in.–Diagonal Color TFT–LCDs without Residual Images", SID 90 Digest, pp. 408–411, 1990.
Okada et al, "An 8.4–in. Color TFT–LCD and the Driving Technologies", Technical Report of IEICE, pp. 27–33, 1993.
U.S. application No. 08/721,717, Kawaguchi et al., filed Sep. 1996.

* cited by examiner

*Primary Examiner*—Bipin Shalwala
*Assistant Examiner*—Vanel Frenel
(74) *Attorney, Agent, or Firm*—Nixon and Vanderhye

(57) ABSTRACT

According to the present invention, a method for driving a display device, including a display panel having a plurality of pixels and a plurality of data lines connected to the respective pixels, is provided. The method includes the steps of: sampling data in a first horizontal interval; storing the data sampled in the first horizontal interval; updating output data based on the stored data in the middle of sampling next data in a second horizontal interval next to the first horizontal interval; and outputting a voltage corresponding to the output data to a corresponding one of the data lines.

10 Claims, 17 Drawing Sheets

METHOD AND CIRCUIT FOR DRIVING DISPLAY DEVICE

RELATED APPLICATION

This application is related to prior copending application Ser. No. 08/721,717 filed Sep. 27, 1996.

BACKGROUND OF THE INVENTION

1. Field of the Invention

The present invention relates to a method and a circuit for driving a display device. More particularly, the present invention relates to a method and a circuit for driving a display device such that the display quality of an active matrix type liquid crystal display device, including active elements such as thin film transistors (TFTs), is less affected by variations of the average of the voltages applied to data lines included in such a display device.

2. Description of the Related Art

First, the fundamental configuration and the operational principles of a conventional digital driver will be described.

FIG. 1A shows a circuit section corresponding to one output of a conventional three-bit digital driver.

This circuit section corresponds to one of a plurality of data lines included in a liquid crystal display panel.

In the following description, this circuit section will be called a "unit driver circuit". The conventional three-bit digital driver includes the same number of unit driver circuits as that of the data lines included in the liquid crystal display panel.

As shown in FIG. 1A, the unit driver circuit includes: a sampling memory $M_{SMP}$; a holding memory $M_H$; and an output circuit section OPC.

The sampling memory $M_{SMP}$ samples three-bit digital image data in synchronism with the leading edge of a sampling pulse $T_{SMP}$.

The holding memory $M_H$ retrieves the image data from the sampling memory $M_{SMP}$ and holds the data therein in synchronism with the leading edge of an output pulse LS which is synchronous with a horizontal synchronizing signal.

The output circuit section OPC selectively outputs one of eight different gray-scale voltages $V_0$ through $V_7$ to a data line $DL_n$ depending upon the value of the image data held in the holding memory $M_H$. Herein, $DL_n$ denotes a data line on an n-th column. The gray-scale voltages $V_0$ through $V_7$ are supplied from the outside of unit driver circuit to the output circuit section OPC. The output pulse LS is supplied to the holding memory $M_H$ after the sampling of data has been completed in all of the unit driver circuits included in the digital driver. Herein, the sampling of data refers to a retrieval of the image data into the sampling memory $M_{SMP}$ in synchronism with the leading edge of the sampling pulse $T_{SMP}$.

FIG. 1B shows a specific configuration of the output circuit section OPC shown in FIG. 1A. The output circuit section OPC includes: a decoder DEC for converting the three-bit image data into eight switch control signals $S_0$ through $S_7$; and analog switches $ASW_0$ through $ASW_7$ for receiving the corresponding switch control signals $S_0$ through $S_7$, respectively, and outputting the gray-scale voltages $V_0$ through $V_7$ corresponding to the switch control signals $S_0$ through $S_7$, respectively, to the data line $DL_n$.

For example, if the value of the image data held in the holding memory $M_H$ is "4", only the switch control signal $S_4$ of the eight switch control signals $S_0$ through $S_7$ which are output from the decoder DEC is activated. As a result, only the analog switch $ASW_4$ of the eight analog switches $ASW_0$ through $ASW_7$ is turned ON. In this manner, the gray-scale voltage $V_4$ input to the analog switch $ASW_4$ is output to the data line $DL_n$.

FIG. 2 shows the waveforms of respective signals in the case of alternating current (AC) driving a liquid crystal display panel. In FIG. 2, Hsync denotes a horizontal synchronizing signal, and POL denotes a signal representing either a time period during which the potential of a pixel electrode is charged to be positive with respect to a voltage $V_{COM}$ applied by a common electrode (hereinafter, such a time period will be referred to as a "positive drive time period") or a time period during which the potential of the pixel electrode is charged to be negative with respect to the voltage $V_{COM}$ applied by the common electrode (hereinafter, such a time period will be referred to as a "negative drive time period"). The signal POL will be called a "polarity signal".

$V_0$, $V_2$, $V_5$ and $V_7$ respectively denote the potentials of the gray-scale voltages $V_0$, $V_2$, $V_5$ and $V_7$ during the positive drive time period, while $-V_0$, $-V_2$, $-V_5$ and $-V_7$ respectively denote the potentials of the gray-scale voltages $V_0$, $V_2$, $V_5$ and $V_7$ during the negative drive time period. It is noted that, in FIG. 2, the gray-scale voltage $V_0$ having a maximum potential difference with respect to the common electrode voltage $V_{COM}$ (and corresponding to the gray-scale data "0"), the gray-scale voltage $V_7$ having a minimum potential difference with respect to the common electrode voltage $V_{COM}$ (and corresponding to the gray-scale data "7") and the gray-scale voltages $V_2$ and $V_5$ having potentials intermediate between the potentials of $V_0$ and $V_7$ (and corresponding to the gray-scale data "2" and "5", respectively) are selectively shown from the eight gray-scale voltages $V_0$ through $V_7$, and the other gray-scale voltages $V_1$, $V_3$, $V_4$ and $V_6$ are omitted.

LS denotes a latch strobe signal which is an output pulse synchronous with the horizontal synchronizing signal Hsync. In response to the signal LS, the image data in the sampling memory $M_{SMP}$ is retrieved into the holding memory $M_H$, and is simultaneously output to the output circuit section OPC.

Moreover, the AC drive shown in FIG. 2 is performed in accordance with a row inversion drive method (also called a "line inversion drive method") in which the positive and the negative drive time periods alternate on the basis of one row (i.e., one gate line) of a liquid crystal display panel. In this case, considering each row, the waveform of each gray-scale voltage is determined such that the positive and negative polarities of each gray-scale voltage are inverted on a frame (i.e., a vertical interval) basis. That is to say, the waveform of each gray-scale voltage is inverted in synchronism with both the horizontal synchronizing signal Hsync and the vertical synchronizing signal Vsync.

FIG. 3 shows the waveform of the gray-scale voltage $V_0$ over two frames. The vertical synchronizing signal Vsync is used for defining one frame (vertical interval) and the horizontal synchronizing signal Hsync is used for defining one horizontal interval. As can be understood from FIG. 3, the polarity of the gray-scale voltage $V_0$ is inverted every horizontal interval within one frame, and the polarity of the gray-scale voltage $V_0$ during a horizontal interval in the former frame is inverse of the polarity of the gray-scale voltage $V_0$ during the corresponding horizontal interval in the latter frame.

In accordance with a conventional drive method, as shown in FIG. 2, the leading edge of the output pulse LS is synchronous with the time at which the level of the gray-scale voltage is changed. This is a condition necessarily determined by the fact that output of new data is started in response to the output pulse LS. As a result, the ratio of the length of a time period during which a desired voltage is output from the driver to the data line to the entire length of a positive/negative drive time period can be maximized.

FIG. 4 shows the waveform of a voltage $W_0$ to be output from a unit driver circuit to a data line over two frames (vertical intervals) in the case of writing display data "0" onto a pixel and the waveform of a voltage $W_{07}$ to be output from the unit driver circuit to the data line over two frames (vertical intervals) in the case of alternately writing the display data "0" and display data "7" onto the pixel, together with the waveforms of the horizontal synchronizing signal Hsync and the vertical synchronizing signal Vsync.

In FIG. 4, Va denotes an average voltage of the output voltage $W_0$ in one frame period. As shown in FIG. 4, in the case of writing the display data "0" onto the pixel, the average voltage Va is constant in two adjacent frames.

In FIG. 4, Va1 denotes an average voltage of the output voltage $W_{07}$ in the first frame of the two successive frames, while Va2 denotes an average voltage of the output voltage $W_{07}$ in the second frame of the two successive frames. As shown in FIG. 4, in the case of alternately writing the display data "0" and the display data "7" onto the pixel, the average voltages are different from each other in the two adjacent frames. It is noted that ΔVa(+) denotes the magnitude of a positive voltage differential of the average voltage Va1 of the output voltage $W_{07}$ with respect to the average voltage Va of the output voltage $W_0$, while ΔVa(−) denotes the magnitude of a negative voltage differential of the average voltage Va2 of the output voltage $W_{07}$ with respect to the average voltage Va of the output voltage $W_0$. As shown in FIG. 4, in the case of alternately writing the display data "0" and the display data "7" onto the pixel, the average voltage of the output voltages is variable in each frame, i.e., becomes either positive or negative with respect to the average voltage Va.

FIG. 5A shows an equivalent circuit corresponding to one pixel. In FIG. 5A, $C_{LC}$ denotes a capacitance determined by a pixel electrode, a common electrode and liquid crystal molecules which are dielectric existing therebetween. $C_{LC}$ is called a "pixel capacitance". The potential difference between the electrodes of a capacitor formed by the pixel capacitance $C_{LC}$ becomes a voltage actually applied to the liquid crystal molecules. $C_S$ denotes an auxiliary capacitance, and $C_{qd}$ denotes a stray capacitance to be generated by the gate electrode and the drain electrode of a TFT functioning as a switching element. It is noted that the auxiliary capacitance $C_S$ may be formed by various structures. For example, the auxiliary capacitance $C_S$ may be formed by an electrode connected to a pixel electrode and an electrode at a common electrode potential.

The transmittance of the liquid crystal molecules is determined based on a potential difference between the pixel electrode and the common electrode. Thus, in the OFF period of the TFTs during which a voltage is actually applied to the liquid crystal molecules, the charge of the capacitance $C_{LC}$ is required to be constant. In the equivalent circuit of the pixel shown in FIG. 5A, it is the potential of the common electrode and that of the gate line of the pixel that affect the charge of the capacitance $C_{LC}$. This means that the potential of the data line is excluded from the factors affecting the display quality.

Therefore, when the OFF period of an ideal TFT is discussed, the potential of the data line is regarded as not affecting the display quality irrespective of whether the average voltages of the voltages output to the data line are constant in successive frames (for example, the case of the output voltage $W_0$ shown in FIG. 4) or different from each other in the successive frames (for example, a case of the output voltage $W_{07}$ shown in FIG. 4).

As described above, in a conventional drive method, the potential of the data line has been regarded as not affecting the potential of the pixel electrode after the TFT has been turned OFF. In other words, the OFF resistance of a TFT functioning as a switching element has been regarded as being infinity and the capacitance of the TFT has been regarded as being zero. Of course, a real TFT cannot be in such an ideal state, because the values of the OFF resistance and the capacitance are limited in a real TFT. Thus, a real TFT may affect the display quality. The degree to which the display quality is affected by the TFT depends upon the material and the structure of the TFT. When the display quality is affected to a large degree, the drive timing, the drive waveform and the like, which have been determined while supposing the equivalent circuit shown in FIG. 5A, are required to be corrected in a certain manner.

FIG. 5B shows an equivalent circuit corresponding to one pixel when the OFF resistance and the source-drain capacitance of the TFT itself have been taken into consideration. As can be seen from FIG. 5B, the potential of the data line affects the amount of charge in an electrode (i.e., the pixel electrode), which is closer to the TFT, of the capacitance $C_{LC}$ via the OFF resistance Roff and the source-drain capacitance $C_{sd}$. It is impossible to determine without reserve the specific level of the OFF resistance Roff and the specific magnitude of the source-drain capacitance $C_{sd}$ which make the degradation in display quality non-negligible.

Specifically, the degree of degradation depends not only on the liquid crystal material of the display medium and the number of gray-scale tones to be displayed, but also on the display pattern. Thus, since the degree of degradation also depends the application of the display device, an absolute criterion for determining the degree of degradation does not exist.

Hereinafter, exemplary defects resulting from the source-drain capacitance $C_{sd}$ of a TFT as is generated in a conventional drive method will be described with reference to FIGS. 6A and 6B.

FIG. 6A shows a screen on which display patterns having a non-negligible defect resulting from the source-drain capacitance $C_{sd}$ of a TFT are displayed. In a central window region E, a uniform display pattern having a luminance corresponding to the display data "7" is displayed. On the other hand, in each of the peripheral regions A, B, C and D surrounding the window region E, a checkered pattern, in which display patterns having a luminance corresponding to the display data "0" and display patterns having a luminance corresponding to the display data "7" alternately appear in the respective pixels, is displayed as shown in FIG. 6B.

If such checkered patterns are displayed, each of the peripheral regions C and D, located above and below the window region E, respectively, has non-uniform luminance values over the entire region. The reason is as follows. Since the average data line potential inside the window region E becomes different from that outside the window region E, the pixel electrode potential is affected by the average data line potential in a different manner in these two types of regions.

FIG. 7 shows the waveform of a voltage output from a unit driver circuit to a data line DL and the variation of the average of the voltage over two frame periods when display patterns such as those shown in FIG. 6A are displayed. The data line DL passes the window region E and the peripheral regions C and D. Herein, it is assumed that the unit driver circuit alternately outputs a positive voltage and a negative voltage, corresponding to the same gray-scale tone, to the data line DL during a retrace interval. It is noted that the specific waveform of the voltage output from the unit driver circuit to the data line DL during the retrace interval is omitted, but the average of the voltage is shown instead.

In order to evaluate the influence of the potential of the data line DL upon the respective pixels, it is necessary to determine the difference among the potentials of all of the time periods t1 through t4'.

First, a pixel located at a position X within the region C shown in FIG. 6A (hereinafter, such a pixel will be referred to as pixel X) will be considered. Assuming that the pixel X is charged to have a first polarity during a horizontal interval x included in a frame (see FIG. 7), the pixel X is charged to have a second polarity inverse of the first polarity during a corresponding horizontal interval x' included in the next frame (see FIG. 7).

The difference between the average potential of the data line DL and the potential of the pixel X is small in a remaining time period succeeding the horizontal interval x of the time period t1 and all through the time period t3. Thus, the influence of potential of the data line DL is less significant during these time periods. On the other hand, the difference between the average potential of the data line DL and the potential of the pixel X is large in a time period preceding the horizontal interval x' of the time period t1'. Thus, the influence of the potential of the data line DL is significant during this time period.

During the time period t1 (more exactly, the time period succeeding the horizontal interval x), the time period t3 and the time period t1' (more exactly, the time period preceding the horizontal interval x'), the drop of the potential of the pixel X with respect to the common electrode potential is equal to that of the potential of the pixels located within the regions A and B and on the same scanning line as that of the pixel X (see $W_{07}$ shown in FIG. 4). Thus, the pixel X and the corresponding pixels within the regions A and B are affected by the potential of the data line DL to the same degree.

During the time period t2, the average potential of the data line DL is the central potential of the positive and the negative gray-scale voltages. Thus, in the time period t2, the drop of the potential of the pixel X with respect to the common electrode potential is larger than that of the potential of the pixels located within the regions A and B and on the same scanning line as the pixel X. This is because, in the regions A and B, the average potential of the data line during the time period t2 is equal to the average potential of the data a line during the time periods t1 and t3.

The time period t4 is a retrace interval. In the time period t4, the drop of the potential of the pixel X with respect to the common electrode potential is equal to that of the potential of the pixels located within the regions A and B and on the same scanning line as the pixel X. Thus, the pixel X and the corresponding pixels within the regions A and B are affected by the potential of the data line DL to the same degree.

Because of the above-described reasons, during a time period from the horizontal interval x until the horizontal interval x', the gray-scale tone in the region C above the window region E is observed as being lighter than the gray-scale tones observed in the regions A and B. The above description is also applicable to the time period from the horizontal interval x' until the horizontal interval x.

Next, a pixel located at a position Y within the region D shown in FIG. 6A (hereinafter, such a pixel will be referred to as a pixel Y) will be considered.

The difference between the average potential of the data line DL and the potential of the pixel Y is large in the time period t1' and a remaining time period preceding the horizontal interval y' of the time period t3'. Thus, the influence of the potential of the data line DL is significant during these time periods. On the other hand, the difference between the average potential of the data line DL and the potential of the pixel Y is small in a time period succeeding the horizontal interval y of the time period t3. Thus, the influence of the potential of the data line DL is less significant during this time period.

During the time period t3 (more exactly, the time period succeeding the horizontal interval y), the time period t1' and the time period t3' (more exactly, the time period preceding the horizontal interval y'), the drop of the potential of the pixel Y with respect to the common electrode potential is equal to that of the potential of the pixels located within the regions A and B and on the same scanning line as the pixel Y. Thus, the pixel Y and the corresponding pixels within the regions A and B are affected by the potential of the data line DL to the same degree.

During the time period t2', the average potential of the data line DL is the central potential of the positive and the negative gray-scale voltages. Thus, in the time period t2', the drop of the potential of the pixel Y with respect to the common electrode potential is smaller than that of the potential of the pixels located within the regions A and B and on the same scanning line as the pixel Y. This is because, in the regions A and B, the average potential of the data line during the time period t2' is equal to the average potential of the data line during the time periods t1' and t3'.

The time period t4 is a retrace interval. In the time period t4, the drop of the potential of the pixel Y with respect to the common electrode potential is equal to that of the potential of the pixels located within the regions A and B and on the same scanning line as the pixel Y. Thus, the pixel Y and the corresponding pixels within the regions A and B are affected by the potential of the data line DL to the same degree.

Because of the above-described reasons, during a time period from the horizontal interval y until the horizontal interval y', the gray-scale tone in the region D below the window region E is observed as being deeper than the gray-scale tones observed in the regions A and B. The above description is also applicable to the time period from the horizontal interval y' until the horizontal interval y.

The gray-scale tones are varied in the regions C and D of FIG. 6A owing to the above-described potential variations.

SUMMARY OF THE INVENTION

According to the present invention, a method for driving a display device, including a display panel having a plurality of pixels and a plurality of data lines connected to the respective pixels, is provided. The method includes the steps of: sampling data in a first horizontal interval; storing the data sampled in the first horizontal interval; updating output data based on the stored data in the middle of sampling next data in a second horizontal interval next to the first horizontal interval; and outputting a voltage corresponding to the output data to a corresponding one of the data lines.

According to another aspect of the present invention, a circuit for driving a display device, including a display panel having a plurality of pixels and a plurality of data lines connected to the respective pixels, is provided. The circuit includes: a sampling memory for storing data sampled in a first horizontal interval; a transfer memory for storing data output from the sampling memory in response to a transfer pulse; a holding memory for storing data output from the transfer memory in response to an output pulse; and an output circuit section for outputting a voltage corresponding to the data stored in the holding memory to a corresponding one of the data lines. The output pulse is supplied to the holding memory in the middle of sampling next data in a second horizontal interval next to the first horizontal interval.

In one embodiment, the transfer pulse is supplied to the transfer memory after the sampling of the data has been completed in the first horizontal interval and before the sampling of the next data is started in the second horizontal interval.

In another embodiment, the data stored in the transfer memory includes a first bit portion and a second bit portion, the holding memory stores the first bit portion of the data, the output circuit section outputs a voltage corresponding to the first bit portion of the data stored in the holding memory and also corresponding to the second bit portion of the data stored in the transfer memory to the data line.

According to still another aspect of the present invention, a circuit for driving a display device, including a display panel having a plurality of pixels and a plurality of data lines connected to the respective pixels, is provided. The circuit includes: a sampling memory for storing data sampled in a first horizontal interval; a holding memory section including a first holding memory and a second holding memory, for storing data output from the sampling memory into one of the first holding memory and the second holding memory, in response to a transfer pulse; a selection circuit section for selectively outputting one of the data stored in the first holding memory and the data stored in the second holding memory, in accordance with a level of an output pulse; and an output circuit section for outputting a voltage corresponding to the data selected by the selection circuit section to a corresponding one of the data lines. The level of the output pulse changes in the middle of sampling next data in a second horizontal interval next to the first horizontal interval.

In one embodiment, the level of the transfer pulse changes after the sampling of the data has been completed in the first horizontal interval and before the sampling of the next data is started in the second horizontal interval.

In another embodiment, the data stored in the sampling memory includes a first bit portion and a second bit portion, the first holding memory stores the first bit portion and the second bit portion of the data, the second holding memory stores the first bit portion of the data, the selection circuit section selectively outputs one of the first bit portion stored in the first holding memory and the first bit portion stored in the second holding memory, and the output circuit section outputs a voltage corresponding to the first bit portion of the data selected by the selection circuit section and also corresponding to the second bit portion of the data stored in the first holding memory to the data line.

Hereinafter, the functions or the effects to be attained by the present invention will be described.

According to the method and the circuit of the present invention, the variation of the average potential of a data line can be restricted within a predetermined range. Thus, it is possible to prevent the display quality from being degraded even if the values of the OFF resistance and the source-drain capacitance of a TFT are limited. Consequently, the quality of the displayed image is improved.

Thus, the invention described herein makes possible the advantage of providing a method and a circuit for driving a display device which can prevent the display quality from being degraded, even if the values of the OFF resistance and the source-drain capacitance of the TFT are limited, by restricting the variation of the average potential of a data line to a predetermined range and which thereby can display an image of a higher quality.

This and other advantages of the present invention will become apparent to those skilled in the art upon reading and understanding the following detailed description with reference to the accompanying figures.

DESCRIPTION OF THE PREFERRED EMBODIMENTS

First, the fundamental principles of the present invention will be described.

A unit driver circuit outputs a voltage corresponding to output data to a data line $DL_n$. The output data is updated every time a predetermined time has passed, and a voltage corresponding to the updated output data is output to the data line $DL_n$. In this specification, the predetermined time period will be called "one output period".

The fundamental concept of the present invention lies in delaying the update of the output data by a predetermined time interval as compared with a conventional drive method. The update of the output data can be delayed by updating the output data, which is based on data sampled in a horizontal interval, in the middle of sampling the next data in a horizontal interval next to the horizontal interval. The predetermined delay time interval may be one half of one output period, for example.

Figure 7:
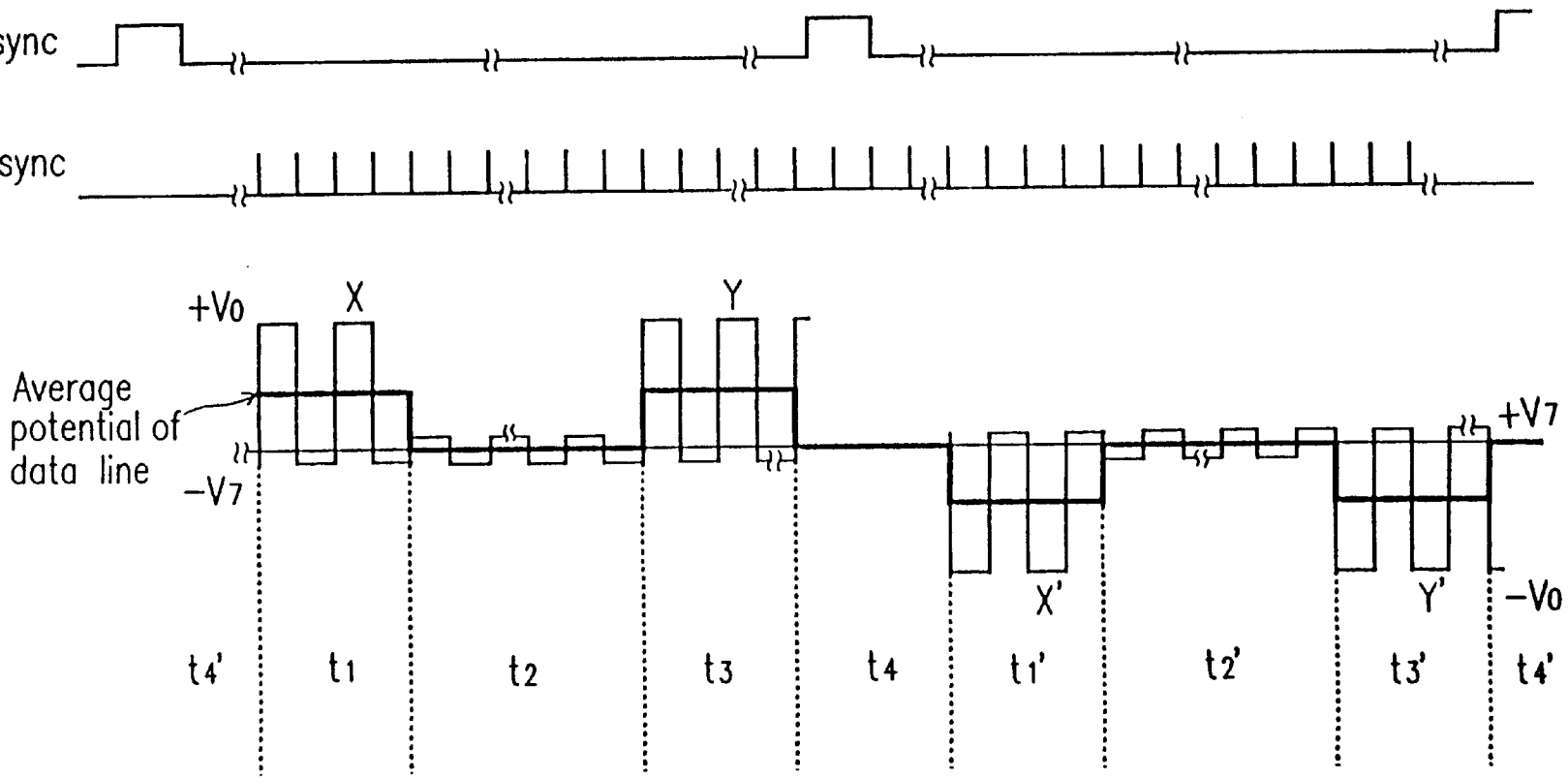
FIG. 7 is a timing diagram showing the waveform of a voltage output from a conventional unit driver circuit to a data line DL and the variation of the average of the voltage over two frame periods.
Figure 8:
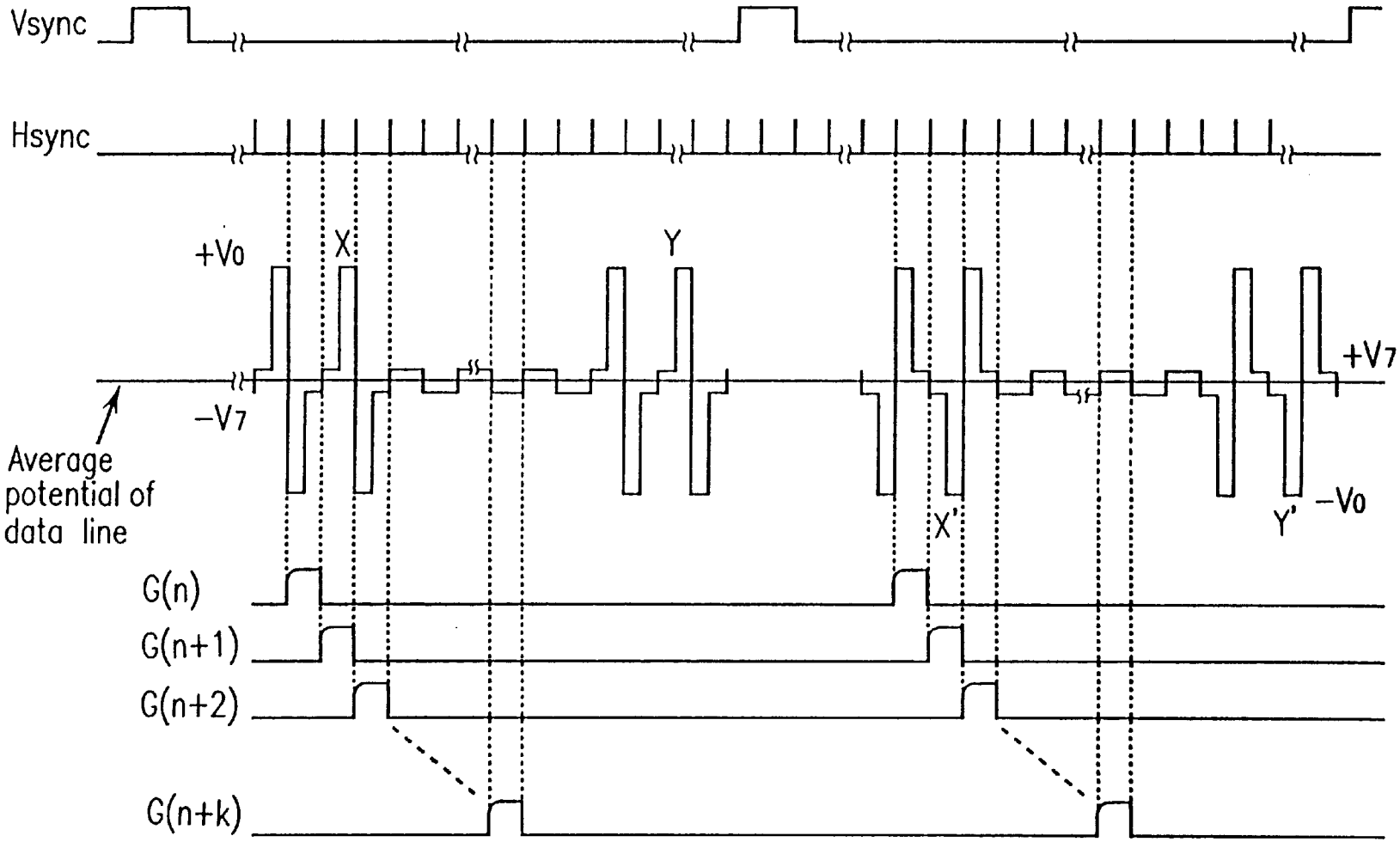
FIG. 8 is a timing diagram illustrating the fundamental principle of the present invention.

By delaying the update of the output data by a time interval corresponding to one half output period, the conventional waveform of an output voltage shown in FIG. 7 is changed into a waveform shown in FIG. 8.

As shown in FIG. 8, a positive voltage and a negative voltage which both correspond to one and the same display data are output to a data line $DL_n$ in the second half of a horizontal interval and the first half of the next horizontal interval, respectively. Thus, irrespective of the location of the display data, the average potential of the data line becomes constant with respect to all the pixels. Consequently, the above-described display defects can be prevented.

It should be noted that the drive timings and the signal waveforms of the components other than the data driver are generally the same as those of a conventional example. The output timings of a gate driver are also shown in FIG. 8.

Furthermore, in the case of alternately writing different display data onto a pixel, a voltage which is different from a desired voltage but has the same polarity as that of the desired voltage with respect to a common electrode potential is applied to the pixel during the first half of one horizontal interval (i.e., the first half of a time period during which a gate is open). Consequently, the pixel is operated at least to have a voltage closer to the desired voltage. In the second half of one horizontal interval, the pixel is charged to have the desired voltage. It is noted that, in the case of continuously writing one and the same display data onto the pixel, the pixel is operated so as to be charged to the desired voltage from the start of the first half of one horizontal interval, in the same way as in a conventional example. In this case, the potential of the common electrode may be either at a DC level or at a level having an inverted polarity.

EXAMPLE 1

Figure 9:
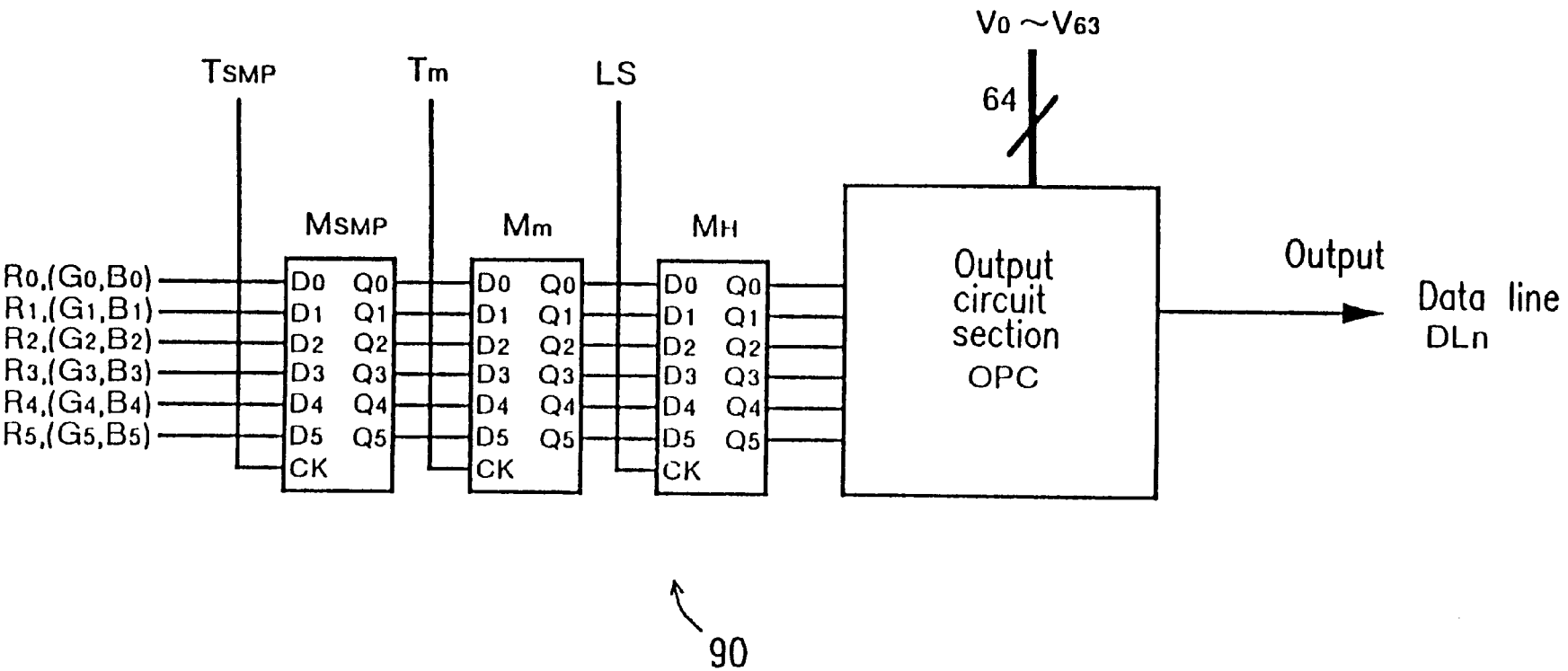
FIG. 9 is a circuit diagram showing a configuration of a circuit section (unit driver circuit 90) corresponding to one output of a six-bit digital driver of the present invention.

FIG. 9 shows a configuration of a circuit section (i.e., a unit driver circuit 90) corresponding to one output of a six-bit digital driver of the present invention. This unit driver circuit 90 corresponds to one of a plurality of data lines included in a liquid crystal display panel. The six-bit digital driver includes the same number of unit driver circuits 90 as that of the data lines included in the liquid crystal display panel.

The unit driver circuit 90 includes: a sampling memory $M_{SMP}$; a transfer memory $M_m$; a holding memory $M_H$; and an output circuit section OPC.

The sampling memory $M_{SMP}$ samples six-bit digital image data in response to a sampling pulse $T_{SMP}$.

The transfer memory $M_m$ retrieves the image data from the sampling memory $M_{SMP}$ and stores the data therein in response to a transfer pulse $T_m$. The transfer pulse $T_m$ is supplied to the transfer memory $M_m$ during a time period after the sampling of data has been completed in all the unit driver circuits 90 included in the digital driver in a horizontal interval and before the sampling of data is started in at least one unit driver circuit 90 included in the digital driver in a horizontal interval next to the horizontal interval. The transfer pulse $T_m$ may be supplied to the transfer memory $M_m$ at an arbitrary point in time during such a time period. Herein, the sampling of data refers to a retrieval of the image data into the sampling memory $M_{SMP}$ in response to the sampling pulse $T_{SMP}$. By supplying the transfer pulse $T_m$ to the transfer memory $M_m$ at such a point in time, the previously sampled data has already been stored in the transfer memory $M_m$ when the sampling of data is started in the next horizontal interval. Thus, the data stored in the transfer memory $M_m$ is not destroyed by the sampling of data in the next horizontal interval.

The holding memory $M_H$ retrieves the image data from the transfer memory $M_m$ and stores the data therein in response to an output pulse LS.

Figure 1A:
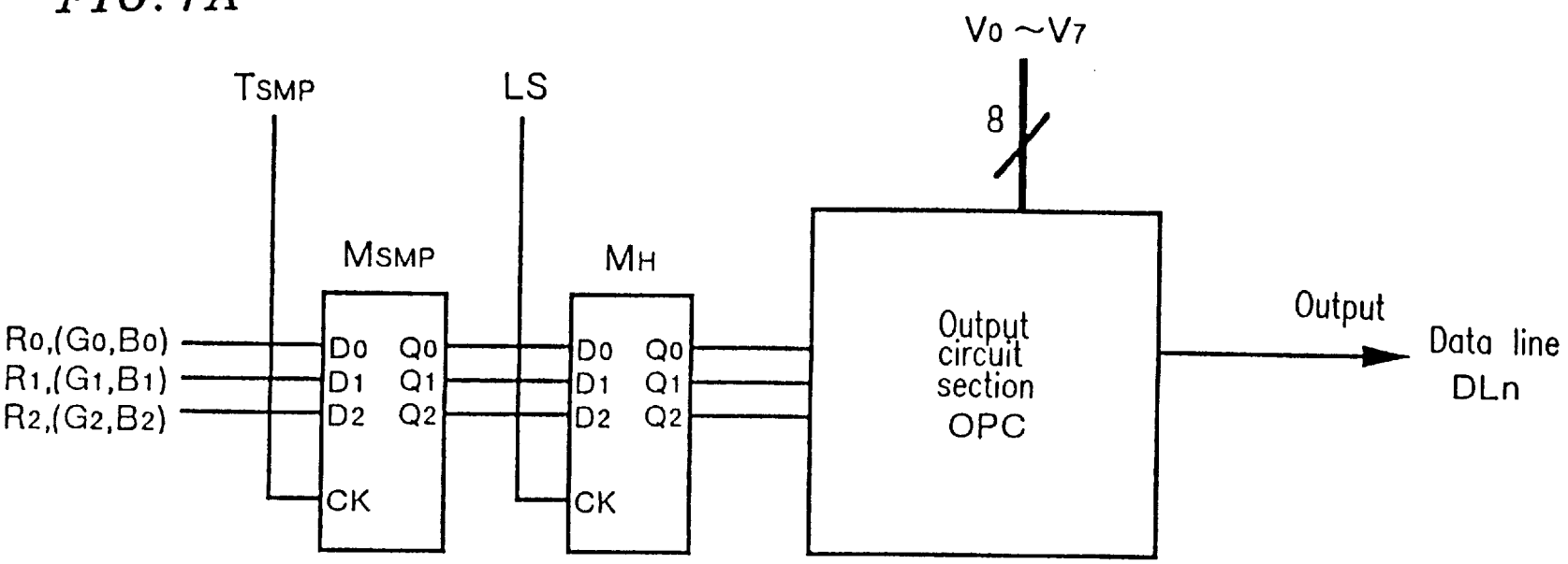
FIG. 1A is a circuit diagram showing the configuration of a circuit section (unit driver circuit) corresponding to one output of a conventional three-bit digital driver.
Figure 1B:
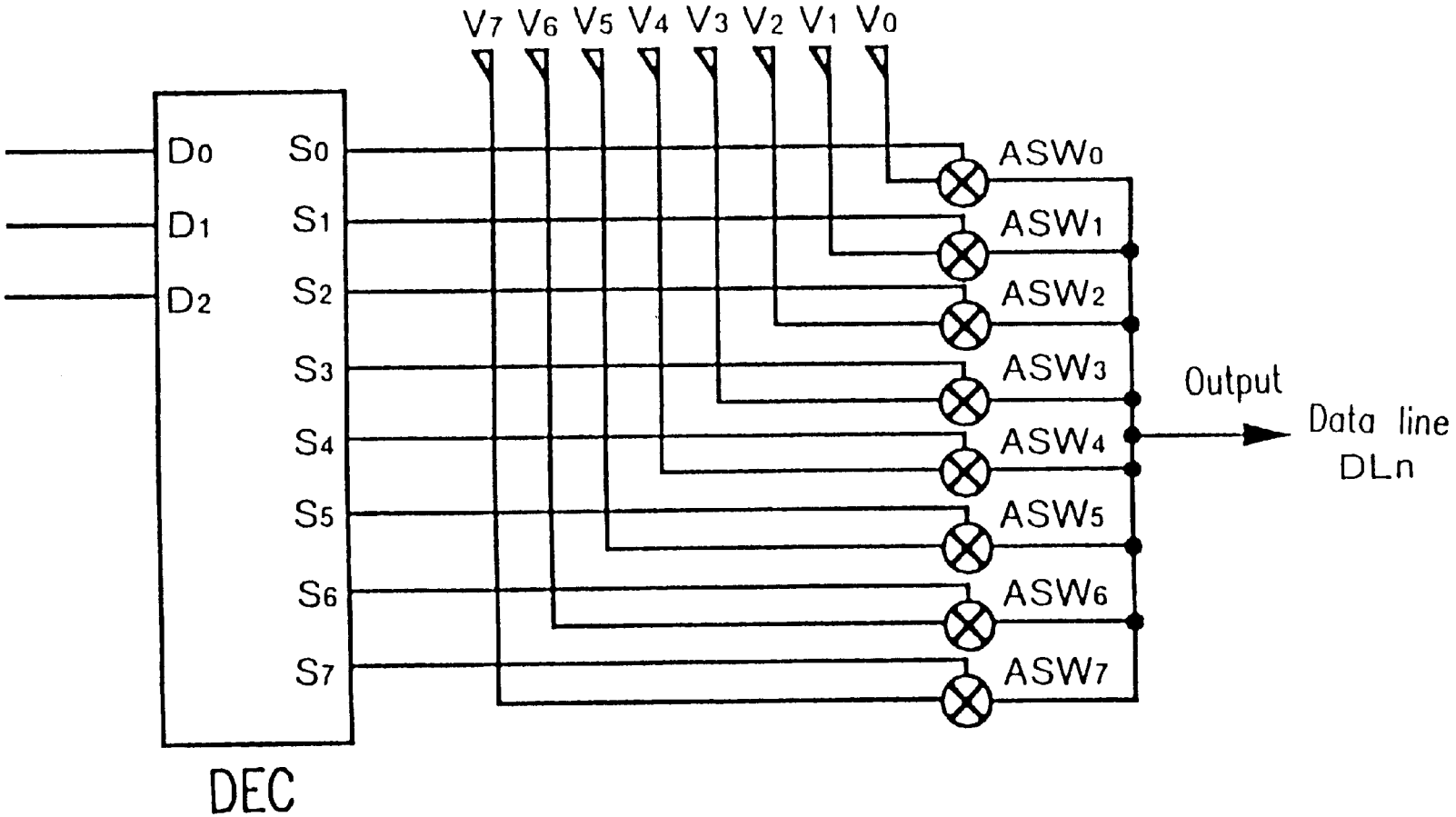
FIG. 1B is a circuit diagram showing the specific configuration of an output circuit section OPC included in the unit driver circuit shown in FIG. 1A.
Figure 2:
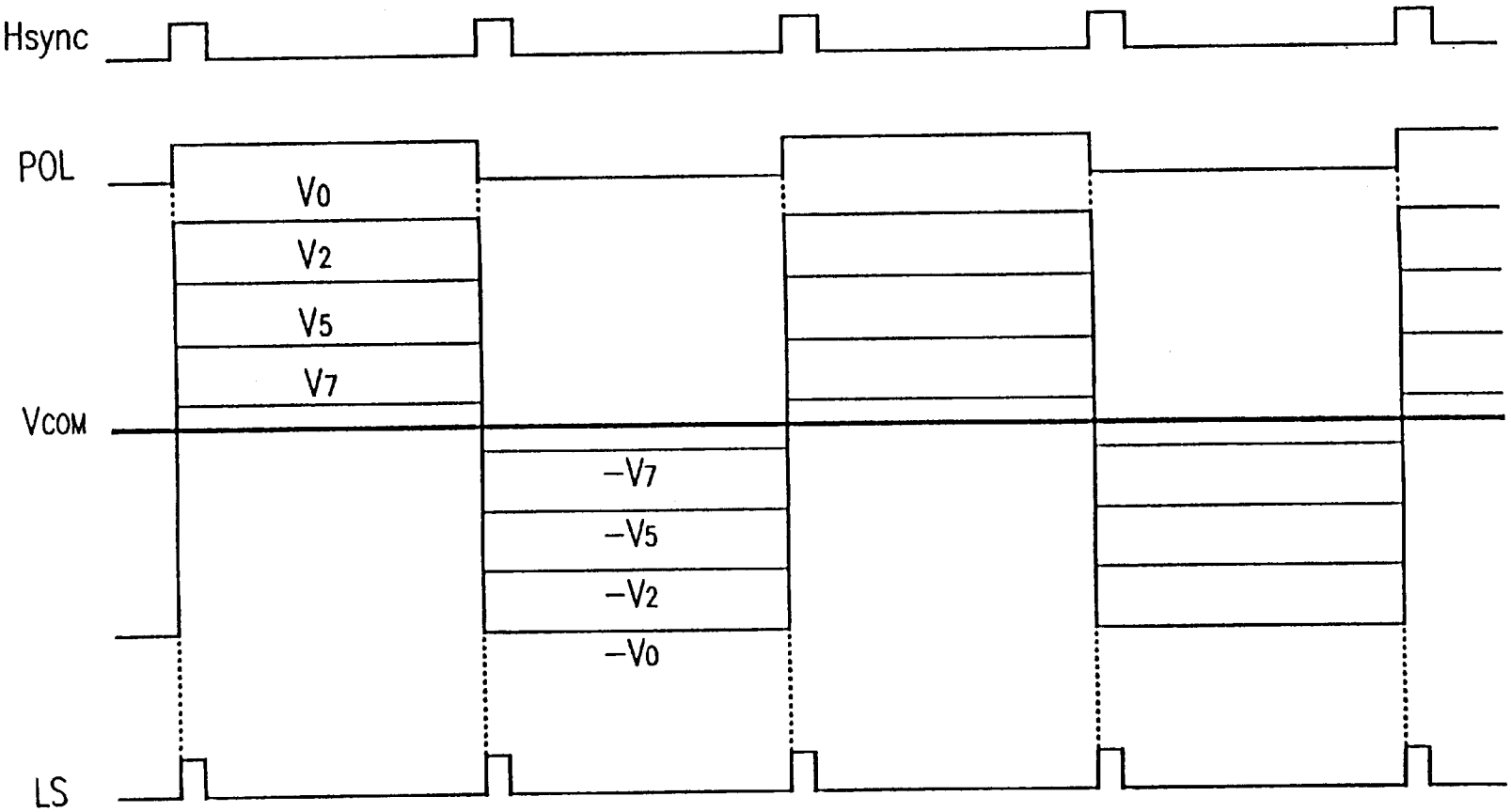
FIG. 2 is a timing diagram showing the waveforms of respective signals in the case of alternating current driving a liquid crystal display panel.
Figure 3:
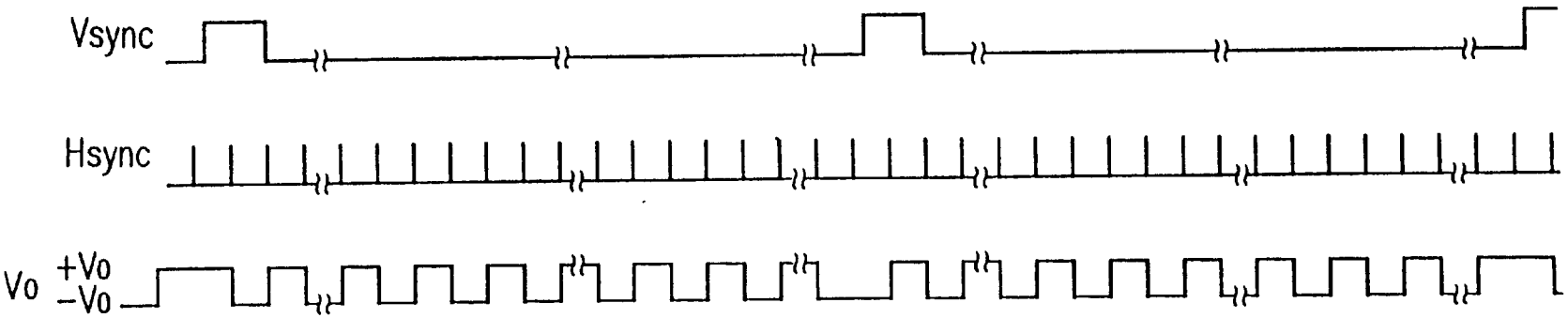
FIG. 3 is a timing diagram showing the waveform of a gray-scale voltage $V_0$ over two frames.
Figure 4:
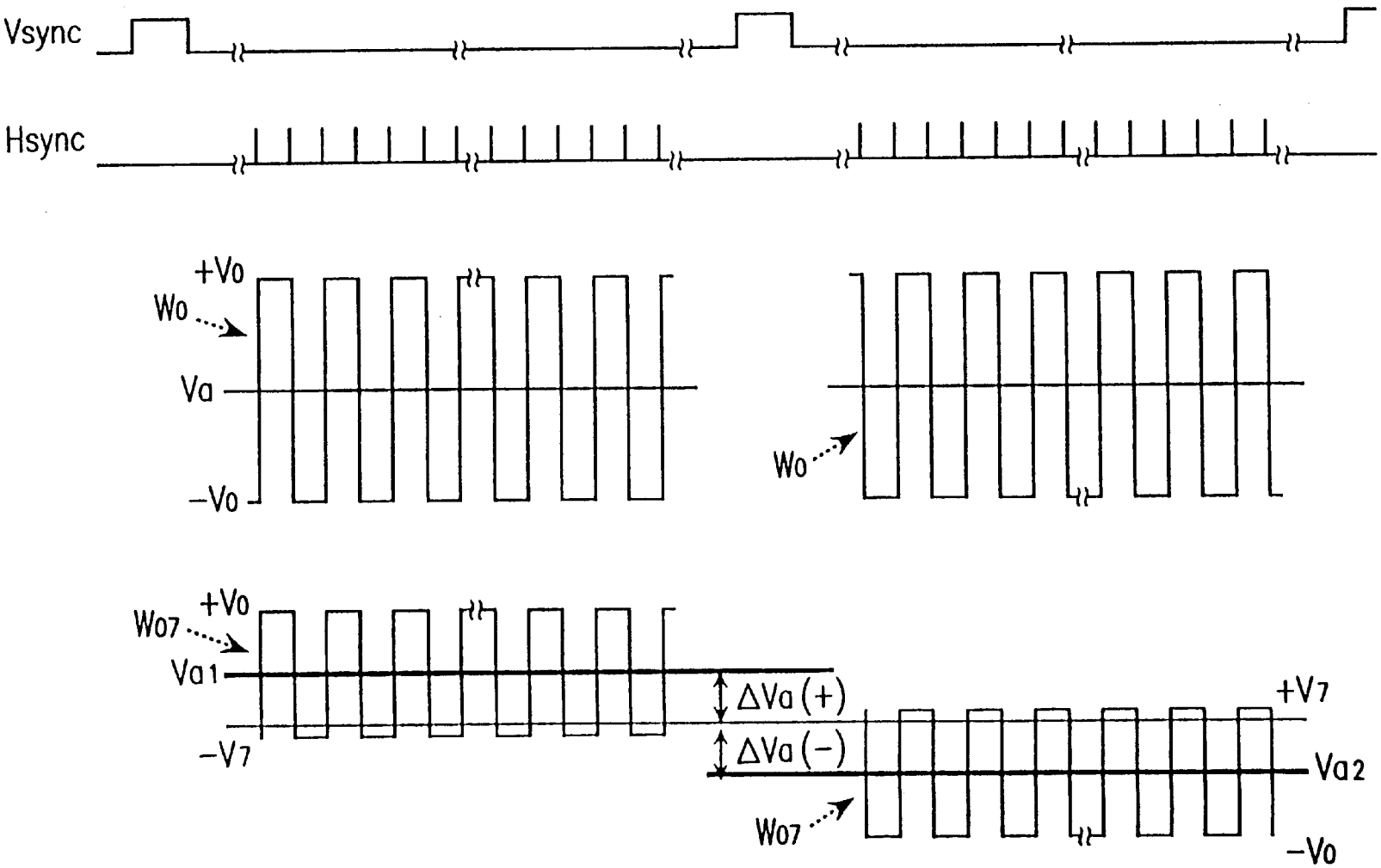
FIG. 4 is a timing diagram showing the waveform of a voltage $W_0$ output from the unit driver circuit to a data line in the case of writing display data "0" onto a pixel and the waveform of a voltage $W_{07}$ output from the unit driver circuit to the data line in the case of alternately writing display data "0" and display data "7" onto the pixel.
Figure 5A:
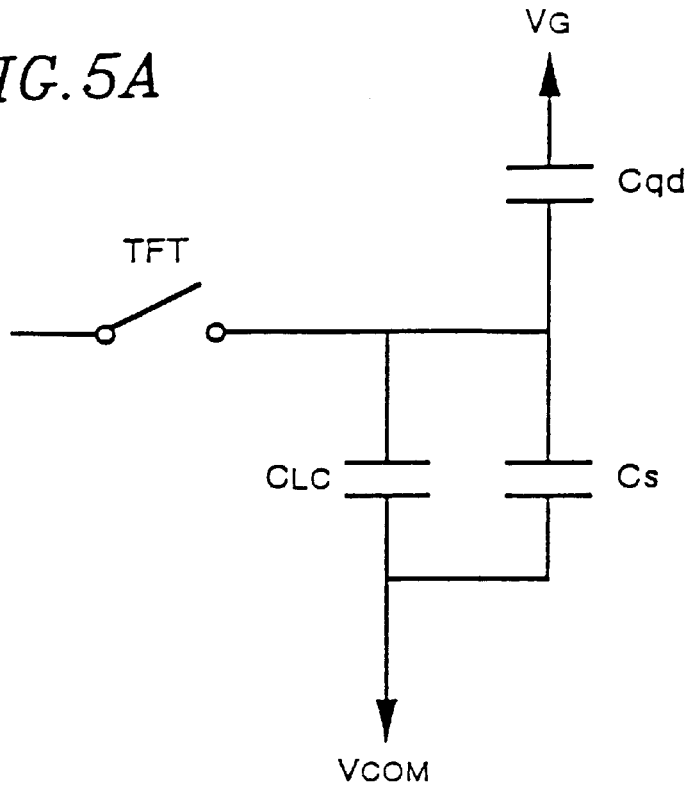
FIGS. 5A and 5B are equivalent circuit diagrams each corresponding to one pixel.
Figure 5B:
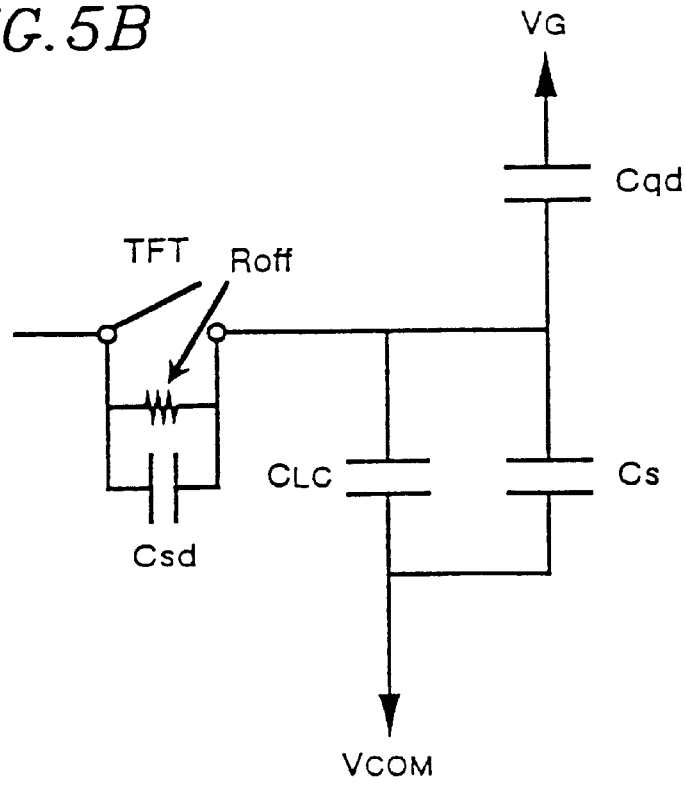
Figure 6A:
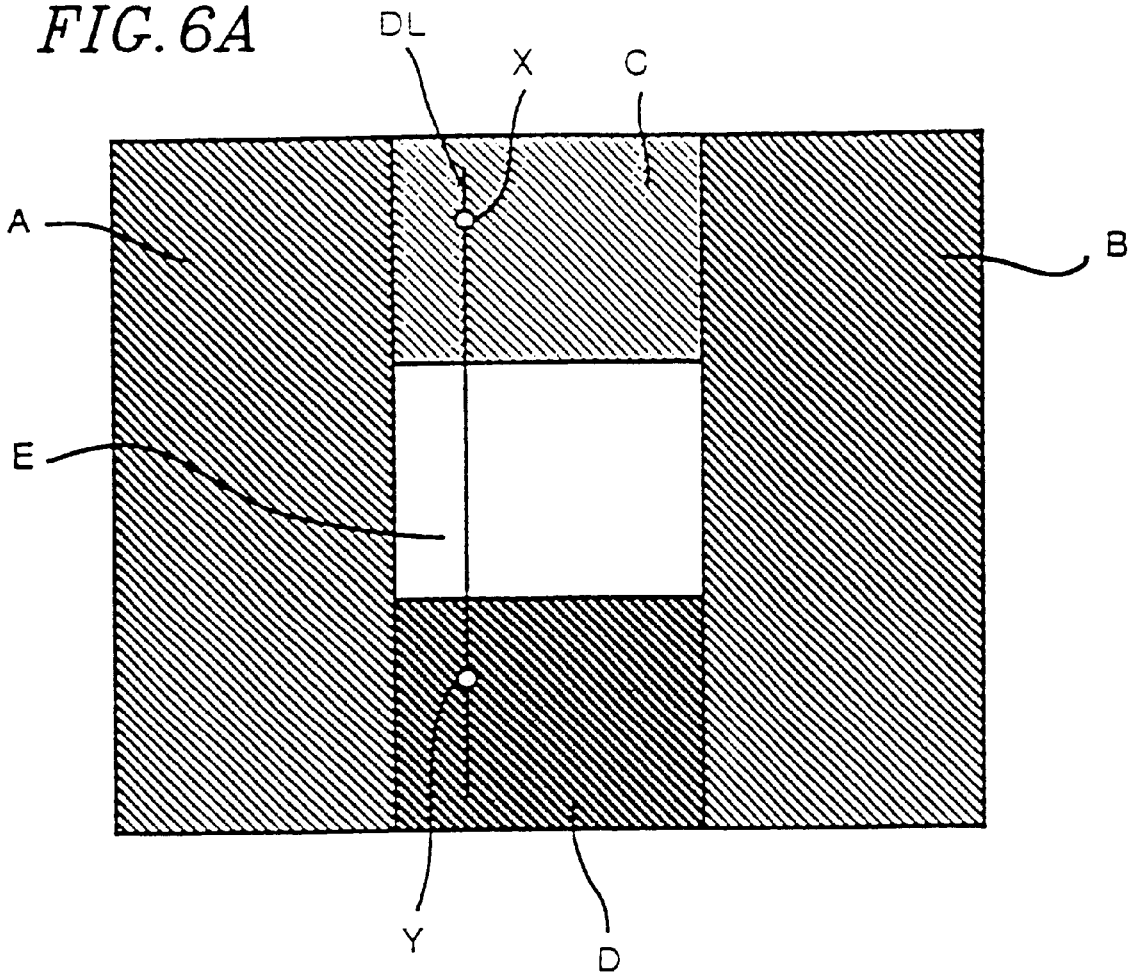
FIGS. 6A and 6B are diagrams for illustrating a defect resulting from a source-drain capacitance $C_{sd}$ of a TFT in a conventional drive method.
Figure 6B:
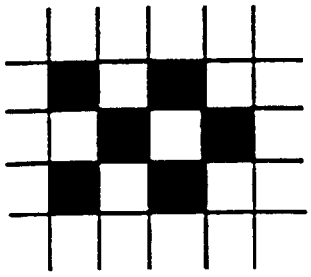

The output circuit section OPC selectively outputs one of 64 different gray-scale voltages $V_0$ through $V_{63}$ to a data line $DL_n$ in accordance with the value of the image data stored in the holding memory $M_H$. Herein, $DL_n$ denotes a data line on an n-th column. The gray-scale voltages $V_0$ through $V_6$ are supplied from the outside of the unit driver circuit 90 to the output circuit section OPC. The output circuit section OPC may have the same configuration as that shown in FIG. 1B, for example. However, the configuration of the output circuit section OPC is not limited thereto. The output circuit section OPC may have an arbitrary configuration so long as the output circuit section OPC can output a voltage corresponding to the image data stored in the holding memory $M_H$.

Figure 10:
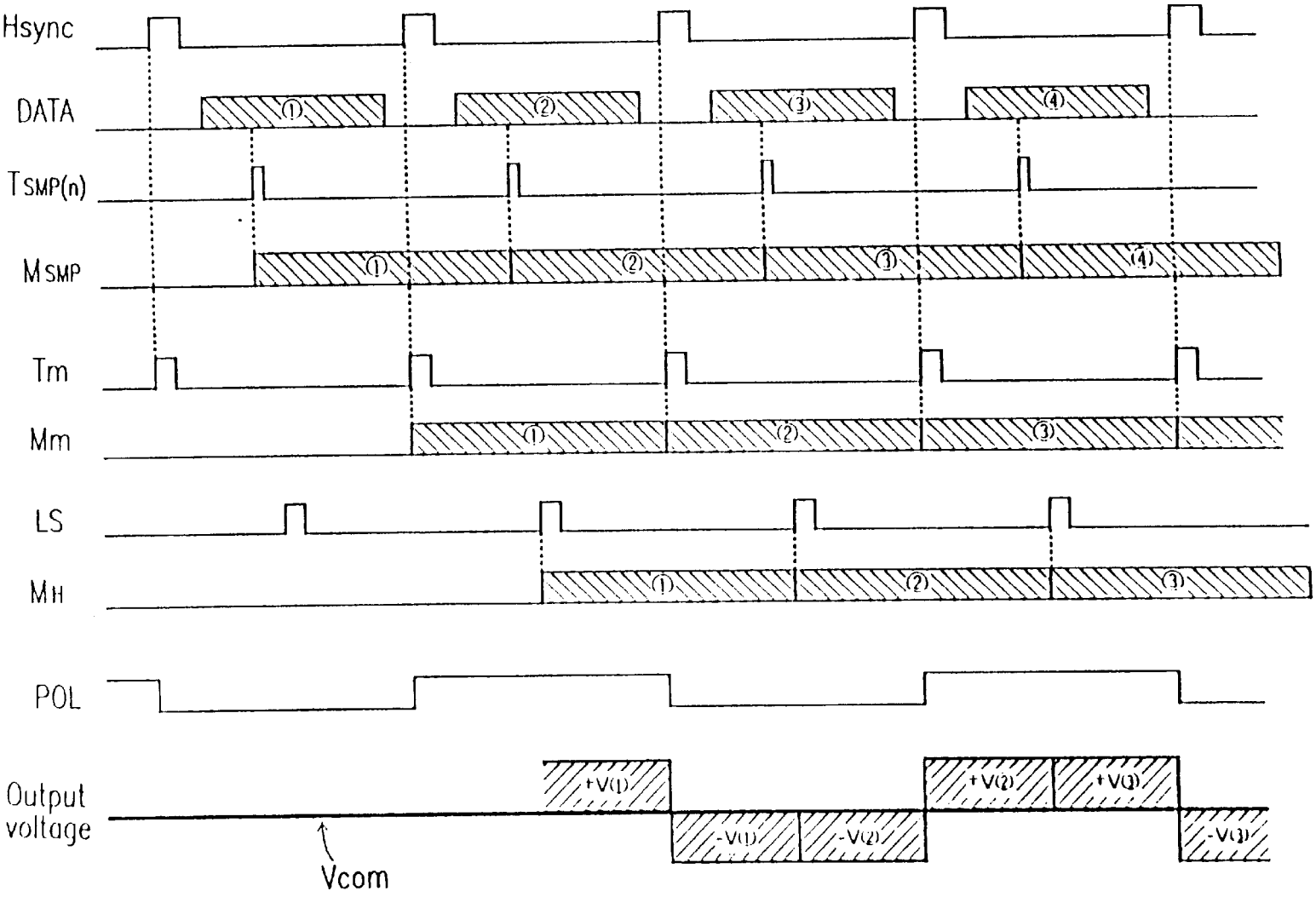
FIG. 10 is a timing diagram showing the waveforms of signals associated with the operation of the unit driver circuit 90 outputting a voltage to a data line $DL_n$.

FIG. 10 shows the waveforms of signals associated with the operation of the unit driver circuit 90 outputting a voltage to the data line $DL_n$ on the n-th column. Herein, n is an integer equal to or larger than 1 and equal to or smaller than N, and N represents the number of data lines.

In FIG. 10, DATA schematically shows the data input to the unit driver circuit 90 every horizontal interval. Hereinafter, the data input to the unit driver circuit 90 every horizontal interval will be denoted by Data ①, ②, ③, ④, . . . , etc.

Data ① is stored in the sampling memory $M_{SMP}$ in response to a sampling pulse $T_{SMP}(n)$ on the n-th column, transferred to the transfer memory $M_m$ in response to a transfer pulse $T_m$, and further transferred to the holding memory $M_H$ in response to an output pulse LS. The output circuit section OPC outputs voltages corresponding to Data ① held in the holding memory $M_H$ to the data line $DL_n$. In FIG. 10, the output voltages corresponding to Data ① are denoted by +V① and −V①.

After Data ① has been transferred to the transfer memory $M_m$, Data ② is stored in the sampling memory $M_{SMP}$ in response to the sampling pulse $T_{SMP}(n)$. Thereafter, this procedure will be repeated. In such a manner, the output voltages −V② and +V② corresponding to Data ②, the output voltages +V③ and −V③ corresponding to Data ③ and so on are sequentially output to the data line $DL_n$.

In the example shown in FIG. 10, the transfer pulse $T_m$ is synchronous with a horizontal synchronizing signal Hsync, and is supplied to the transfer memory $M_m$ at the same time. However, the time at which the transfer pulse $T_m$ is supplied to the transfer memory $M_m$ is not limited thereto. As described above, the transfer pulse $T_m$ may be supplied to the transfer memory $M_m$ at an arbitrary point in time during a time period after the sampling of data has been completed in a horizontal interval and before sampling of data is started in the next horizontal interval.

The output pulse LS is supplied to the holding memory $M_H$ in the middle of sampling the data during one horizontal interval. For example, the output pulse LS may be supplied to the holding memory $M_H$ at a middle point of one horizontal interval.

A polarity signal POL is used for defining a positive drive time period and a negative drive time period. The positive drive time period and the negative drive time period alternate on a horizontal interval basis.

The output circuit section OPC outputs a voltage, which is positive with respect to a common electrode voltage $V_{COM}$, to the data line $DL_n$ during a positive drive time period, and outputs a voltage, which is negative with respect to the common electrode voltage $V_{COM}$, to the data line $DL_n$ during a negative drive time period.

In this way, in the first half of a horizontal interval, a negative output voltage −V① corresponding to Data ① is output to the data line $DL_n$. In the second half of the horizontal interval, a negative output voltage −V② corresponding to Data ② is output to the data line $DL_n$. Subsequently, in the first half of the next horizontal interval, a positive output voltage +V② corresponding to Data ② is output to the data line $DL_n$. In the second half of the horizontal interval, a positive output voltage +V③ corresponding to Data ③ is output to the data line $DL_n$. Thereafter, voltages are repeatedly output in this manner. This means that voltages corresponding to the same data and having mutually inverse polarities are output to the data line $DL_n$ in the second half of a horizontal interval and in the first half of the next horizontal interval succeeding the horizontal interval, respectively. Consequently, the average potential of the data line $DL_n$ can be constant.

It is noted that the transfer memory $M_m$ and the holding memory $M_H$ are equivalent circuit components. Thus, the transfer memory $M_m$ may be interpreted either as having been inserted between the sampling memory $M_{SMP}$ and the holding memory $M_H$ or as having been added as the posterior stage of the holding memory $M_H$. It will be appreciated that these memories are named for convenience and thus the nomenclature has nothing to do with the essence of the present invention.

EXAMPLE 2

Figure 11:
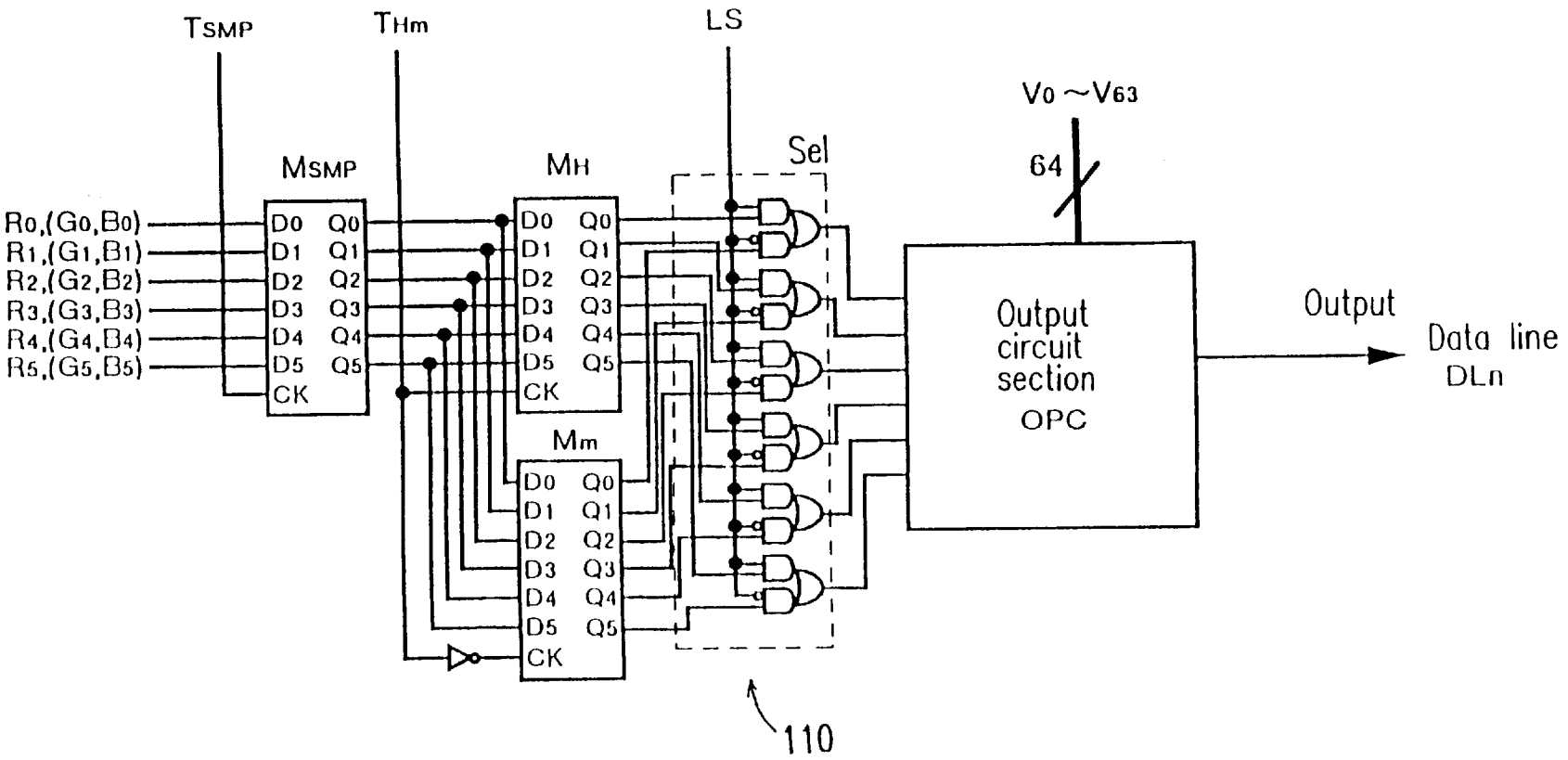
FIG. 11 is a circuit diagram showing a configuration of a circuit section (unit driver circuit 110) corresponding to one output of the six-bit digital driver of the present invention.

FIG. 11 shows a configuration of a circuit section (i.e., a unit driver circuit 110) corresponding to one output of a six-bit digital driver of the present invention. This unit driver circuit 110 corresponds to one of a plurality of data lines included in a liquid crystal display panel. The six-bit digital driver includes the same number of unit driver circuits 110 as that of the data lines included in the liquid crystal display panel.

The unit driver circuit 110 includes: a sampling memory $M_{SMP}$; a first holding memory $M_H$; a second holding memory $M_m$; a selection circuit section Sel; and an output circuit section OPC. The first holding memory $M_H$ and the second holding memory $M_m$ are connected in parallel to the sampling memory $M_{SMP}$.

The sampling memory $M_{SMP}$ samples six-bit digital image data in response to a sampling pulse $T_{SMP}$.

The first holding memory $M_H$ retrieves the image data from the sampling memory $M_{SMP}$ and stores the data therein in response to the leading edge of a transfer pulse $T_{Hm}$. On the other hand, the second holding memory $M_m$ retrieves the image data from the sampling memory $M_{SMP}$ and stores the data therein in response to the trailing edge of the transfer pulse $T_{Hm}$. Naturally, the relationship between the leading edge and the trailing edge of the transfer pulse $T_{Hm}$ may be inverted.

The transfer pulse $T_{Hm}$ is used for defining a time at which the image data stored in the sampling memory $M_{SMP}$ is selectively output to one of the first holding memory $M_H$ and the second holding memory $M_m$. The transfer pulse $T_{Hm}$ is a signal inverted in synchronism with a horizontal synchronizing signal Hsync. The transfer pulse $T_{Hm}$is inverted during a time period ranging from a time when the sampling of data has been completed in all the unit driver circuits 110 included in the digital driver in a horizontal interval to a time when the sampling of data is started in at least one unit driver circuit 110 included in the digital driver in the next horizontal interval succeeding the horizontal interval. The transfer pulse $T_{Hm}$ may be inverted at an arbitrary point in time during such a time period. By inverting the transfer pulse $TH_m$ at such a time, the previously sampled data has already been stored either in the first holding memory $M_H$ or in the second holding memory $M_m$ when the sampling of data is started in the next horizontal interval. Thus, the data stored either in the first holding memory $M_H$ or in the second holding memory $M_m$ is not destroyed by the sampling of data in the next horizontal interval.

The outputs of the first holding memory $M_H$ and the second holding memory $M_m$ are supplied to the selection circuit section Sel.

The selection circuit section Sel selectively outputs either the output of the first holding memory $M_H$ or the output of the second holding memory $M_m$ to the output circuit section OPC in accordance with the level of an output pulse LS.

The output circuit section OPC outputs a voltage, corresponding to the image data output from the selection circuit section Sel, to the data line $DL_n$. For example, the output circuit section OPC selectively outputs one of 64 different gray-scale voltages $V_0$ through $V_{63}$ to the data line $DL_n$ in accordance with the value of the image data. Herein, $DL_n$ denotes a data line on an n-th column.

Figure 12:
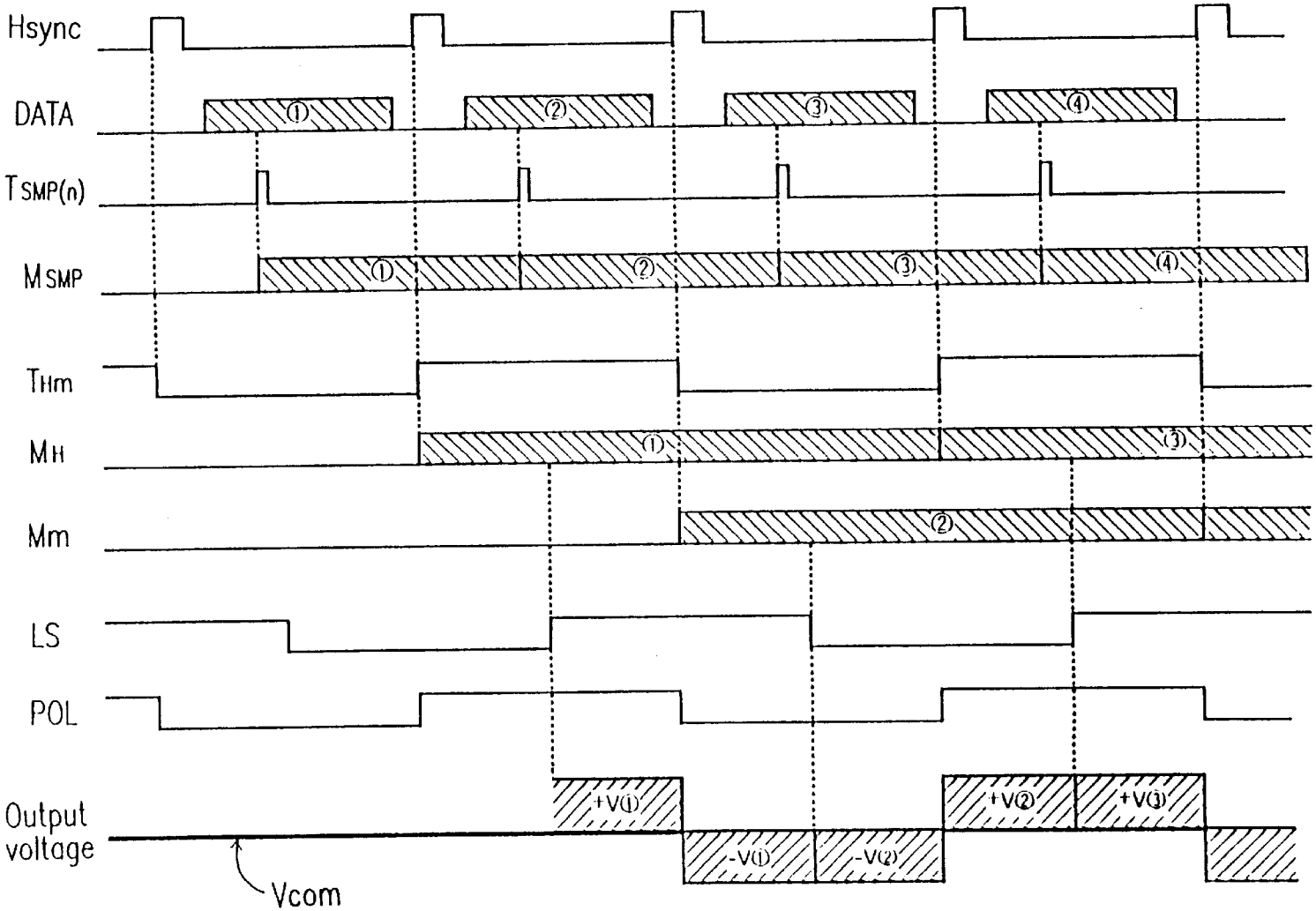
FIG. 12 is a timing diagram showing the waveforms of signals associated with the operation of the unit driver circuit 110 outputting a voltage to a data line $DL_n$.

FIG. 12 shows the waveforms of signals associated with the operation of the unit driver circuit 110 outputting a voltage to the data line $DL_n$ on the n-th column. Herein, n is an integer equal to or larger than 1 and equal to or smaller than N, and N represents the number of data lines.

In FIG. 12, DATA schematically shows the data input to the unit driver circuit 110 every horizontal interval. Hereinafter, the data input to the unit driver circuit 110 every horizontal interval will be denoted by Data ①, ②, ③, ④, . . . , etc.

Data ① is stored in the sampling memory $M_{SMP}$ in response to a sampling pulse $T_{SMP}$(n) on the n-th column, and transferred to the first holding memory $M_H$ in response to the leading edge of the transfer pulse $T_{Hm}$. The first holding memory $M_H$ is selected by the selection circuit section Sel in response to the output pulse LS. The output circuit section OPC outputs voltages corresponding to Data ① held in the first holding memory $M_H$ selected by the selection circuit section Sel to the data line $DL_n$. In FIG. 12, the output voltages corresponding to Data ① are denoted by +V① and −V①.

After Data ① has been transferred to the first holding memory $M_H$, Data ② is stored in the sampling memory $M_{SMP}$ in response to the sampling pulse $T_{SMP}$(n). Thereafter, Data ② is transferred to the second holding memory $M_m$ in response to the trailing edge of the transfer pulse $T_{Hm}$. The second holding memory $M_m$ is selected by the selection circuit section Sel in response to the output pulse LS. The output circuit section OPC outputs voltages corresponding to Data ② held in the second holding memory $M_m$ selected by the selection circuit section Sel to the data line $DL_n$. In FIG. 12, the output voltages corresponding to Data ② are denoted by +V② and −V②.

After Data ② has been transferred to the second holding memory $M_m$, Data ③ is stored in the sampling memory $M_{SMP}$ in response to the sampling pulse $T_{SMP}$(n). Thereafter, this procedure will be repeated. In this way, the output voltages +V③ and −V③ corresponding to Data ③, the output voltages −V④ and +V④ corresponding to Data ④ and so on are sequentially output to the data line $DL_n$.

In the example shown in FIG. 12, the transfer pulse $T_{Hm}$ is inverted every horizontal interval in synchronism with the horizontal synchronizing signal Hsync. The output pulse LS is inverted every horizontal interval so as to be shifted from the transfer pulse $T_{Hm}$ by a predetermined phase. The predetermined phase shift may be equal to one fourth of one period of the transfer pulse $T_{Hm}$, for example. In this manner, data is alternately stored in the first holding memory $M_H$ and the second holding memory $M_m$ every horizontal interval, and the data stored in the first holding memory $M_H$ and the second holding memory $M_m$ is alternately output to the output circuit section OPC every horizontal interval.

A polarity signal POL is used for defining a positive drive time period and a negative drive time period. The positive drive time period and the negative drive time period alternate on a horizontal interval basis.

The output circuit section OPC outputs a voltage, which is positive with respect to a common electrode voltage $V_{COM}$, to the data line $DL_n$ during a positive drive time period, and outputs a voltage, which is negative with respect to the common electrode voltage $V_{COM}$, to the data line $DL_n$ during a negative drive time period.

In this way, in the first half of a horizontal interval, a negative output voltage −V① corresponding to Data ① is output to the data line $DL_n$. In the second half of the horizontal interval, a negative output voltage −V② corresponding to Data ② is output to the data line $DL_n$. Subsequently, in the first half of the next horizontal interval, a positive output voltage +V② corresponding to Data ② is output to the data line $DL_n$. In the second half of the horizontal interval, a positive output voltage +V③ corresponding to Data ③ is output to the data line $DL_n$. Thereafter, voltages are repeatedly output in this manner. This means that voltages corresponding to the same data and having mutually inverse polarities are output to the data line $DL_n$ in the second half of a horizontal interval and in the first half of the next horizontal interval succeeding the horizontal interval, respectively. Consequently, the average potential of the data line $DL_n$ can be constant.

EXAMPLE 3

Figure 13:
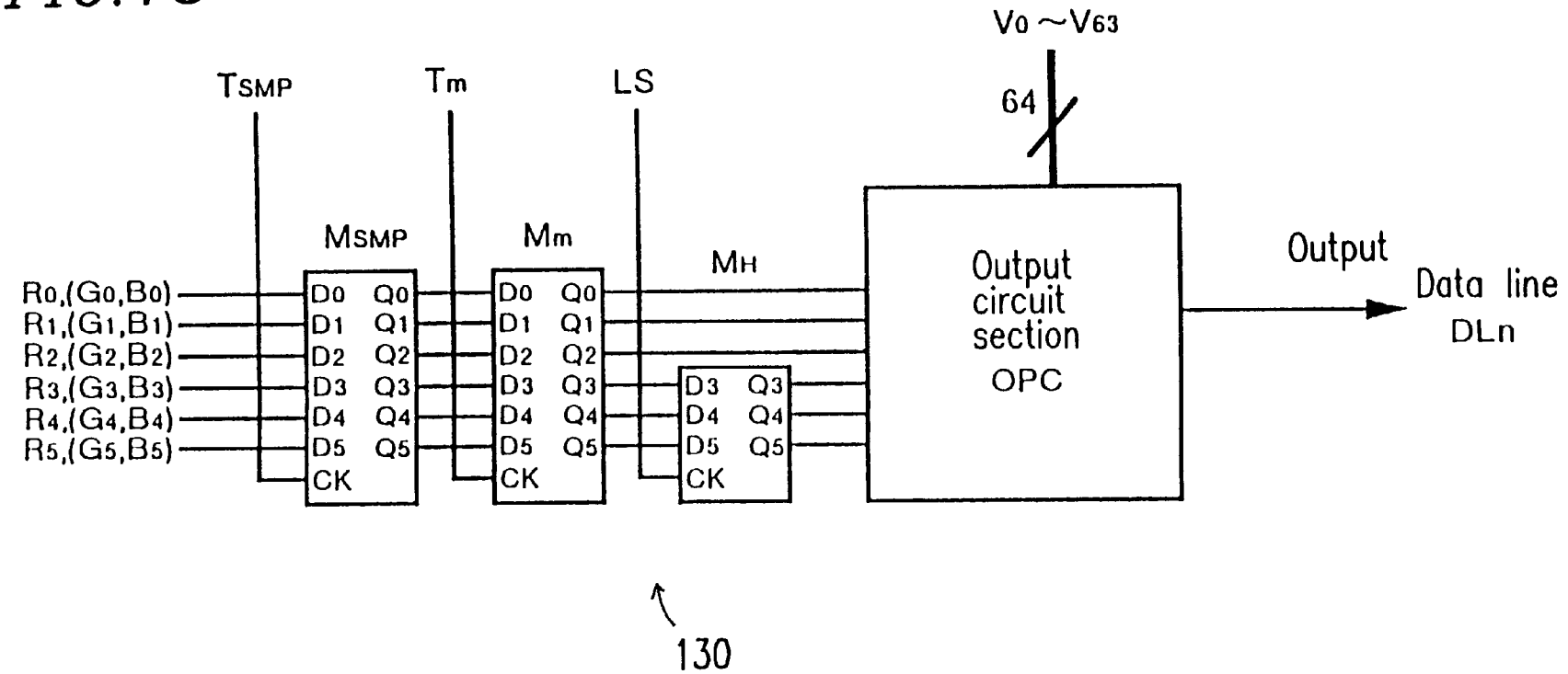
FIG. 13 is a circuit diagram showing a configuration of a circuit section (unit driver circuit 130) corresponding to one output of the six-bit digital driver of the present invention.

FIG. 13 shows a configuration of a circuit section (i.e., a unit driver circuit 130) corresponding to one output of a six-bit digital driver of the present invention. This unit driver circuit 130 is a variant of the unit driver circuit 90 shown in FIG. 9.

The unit driver circuit 130 is different from the unit driver circuit 90 in that the holding memory $M_H$ of the unit driver circuit 130 is configured so as to hold only the upper three bits of the six-bit image data. If only the upper three bits are held, then an effect can be attained in that the holding memory $M_H$ can be configured by a smaller number of elements. For example, assume that the holding memory $M_H$ is made up of D flip-flops. In such a case, if the holding memory $M_H$ is to hold six bits, the holding memory $M_H$ requires six D flip-flops. In contrast, if the holding memory $M_H$ is to hold three bits, the holding memory $M_H$ requires only three D flip-flops.

Figure 14:
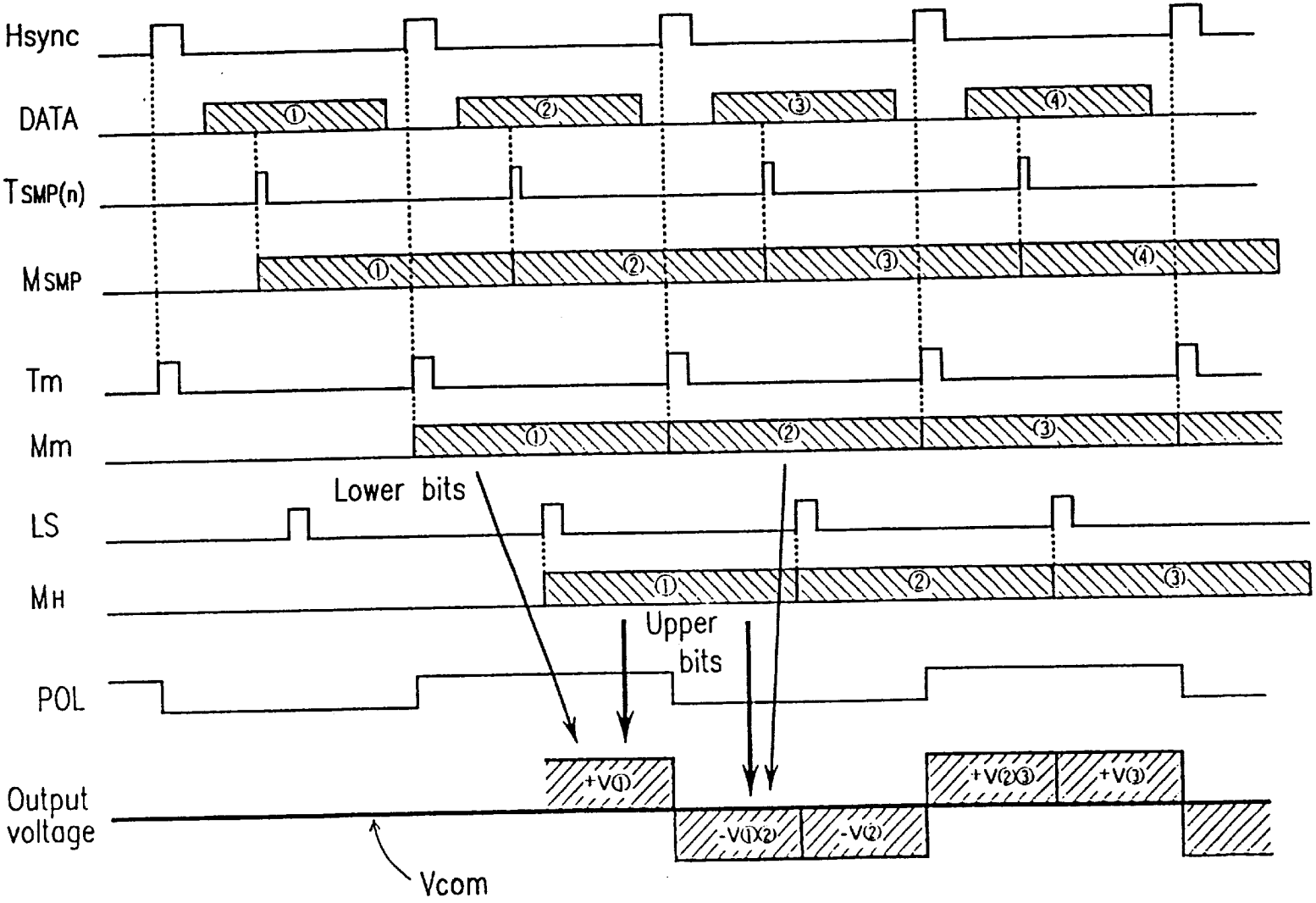
FIG. 14 is a timing diagram showing the waveforms of signals associated with the operation of the unit driver circuit 130 outputting a voltage to a data line $DL_n$.

FIG. 14 shows the waveforms of signals associated with the operation of the unit driver circuit 130 outputting a voltage to the data line $DL_n$ on the n-th column. Herein, n is an integer equal to or larger than 1 and equal to or smaller than N, and N represents the number of data lines.

In FIG. 14, DATA schematically shows the data input to the unit driver circuit 130 every horizontal interval. Hereinafter, the data input to the unit driver circuit 130 every horizontal interval will be denoted by Data ①, ②, ③, ④, . . . , etc.

Data ① is stored in the sampling memory $M_{SMP}$ in response to a sampling pulse $T_{SMP}$(n) on the n-th column, and transferred to the transfer memory $M_m$ in response to a transfer pulse $T_m$. The lower bits of Data ① stored in the transfer memory $M_m$ are directly output to the output circuit section OPC. On the other hand, the upper bits of Data ① stored in the transfer memory $M_m$ are transferred to the holding memory $M_H$ in response to an output pulse LS. The output circuit section OPC outputs a voltage corresponding to the lower bits of the data held in the transfer memory $M_m$ and also corresponding to the upper bits of the data held in the holding memory $M_H$ to the data line $DL_n$.

After Data ① has been transferred to the transfer memory $M_m$, Data ② is stored in the sampling memory $M_{SMP}$ in response to the sampling pulse $T_{SMP}$(n). Thereafter, this procedure will be repeated.

In the example shown in FIG. 14, the transfer pulse $T_m$ is synchronous with the horizontal synchronizing signal Hsync, and is supplied to the transfer memory $M_m$ at the same time. However, the time at which the transfer pulse $T_m$ is supplied to the transfer memory $M_m$ is not limited thereto. As described above, the transfer pulse $T_m$ may be supplied to the transfer memory $M_m$ at an arbitrary point in time during a time period after the sampling of data has been completed in a horizontal interval and before the sampling of data is started in the next horizontal interval.

The output pulse LS is supplied to the holding memory $M_H$ in the middle of sampling the data in one horizontal interval. For example, the output pulse LS may be supplied to the holding memory $M_H$ at a middle point of one horizontal interval.

A polarity signal POL is used for defining a positive drive time period and a negative drive time period. The positive drive time period and the negative drive time period alternate on a horizontal interval basis.

The output circuit section OPC outputs a voltage, which is positive with respect to a common electrode voltage $V_{COM}$, to the data line $DL_n$ during a positive drive time period, and outputs a voltage, which is negative with respect to the common electrode voltage $V_{COM}$, to the data line $DL_n$ during a negative drive time period.

In this way, in the first half of a horizontal interval, a negative output voltage −V①② in which the upper bits correspond to Data ① and the lower bits correspond to Data ② is output to the data line $DL_n$. In the second half of the horizontal interval, a negative output voltage −V② corresponding to Data ② is output to the data line $DL_n$. Subsequently, in the first half of the next horizontal interval, a positive output voltage +V②③ in which the upper bits correspond to Data ② and the lower bits correspond to Data ③ is output to the data line $DL_n$. In the second half of the horizontal interval, a positive output voltage +V③ corresponding to Data ③ is output to the data line $DL_n$. Thereafter, voltages are repeatedly output in this manner.

In this way, voltages corresponding to the same data and having mutually inverse polarities are output to the data line $DL_n$ in the second half of a horizontal interval and in the first half of the next horizontal interval succeeding the horizontal interval, respectively. Strictly speaking, the average of the voltage output to the data line $DL_n$ in the second half of a horizontal interval is not equal to the average of the voltage output to the data line $DL_n$ in the first half of the next horizontal interval succeeding the horizontal interval, because the lower bits are not held in the holding memory $M_H$. However, this fact is negligible in respect of display quality. This is because the voltages corresponding to the same upper bits and having mutually inverse polarities are output to the data line $DL_n$ in the second half of a horizontal interval and in the first half of the next horizontal interval succeeding the horizontal interval, since the upper bits are held in the holding memory $M_H$.

In particular, when the upper bits of image data are more significant than the lower bits thereof in determining a display gray-scale tone, the configuration of this example is effective. For example, this example is suitably applicable to a case where a first gray-scale voltage and a second gray-scale voltage are specified based on the upper bits of image data and the first gray-scale voltage and the second gray-scale voltage are interpolated based on the lower bits of the image data.

In this example, the upper three bits of image data are assumed to be stored in the holding memory $M_H$. However, the number of bits to be stored in the holding memory $M_H$ is not limited to three. For example, one most significant bit (or two upper bits) of the image data may be stored in the holding memory $M_H$. Alternatively, the upper four bits (or the upper five bits) of the image data may be stored in the holding memory $M_H$. Furthermore, an arbitrary number of bits of the six-bit image data may be stored in the holding memory $M_H$.

It is noted that the transfer memory $M_m$ and the holding memory $M_H$ are equivalent circuit components. Thus, the transfer memory $M_m$ may be interpreted as having been added as the posterior stage of the holding memory $M_H$ instead of being interpreted as having been inserted between the sampling memory $M_{SMP}$ and the holding memory $M_H$. In this case, it is also possible to interpret that the number of bits to be stored in the transfer memory $M_m$ has been reduced. However, it will be appreciated that these memories are named for convenience and thus the nomenclature has nothing to do with the essence of the present invention.

As described above, in this third example, the size of a unit driver circuit can be reduced without substantially deteriorating the display quality as compared with the first example.

EXAMPLE 4

Figure 15:
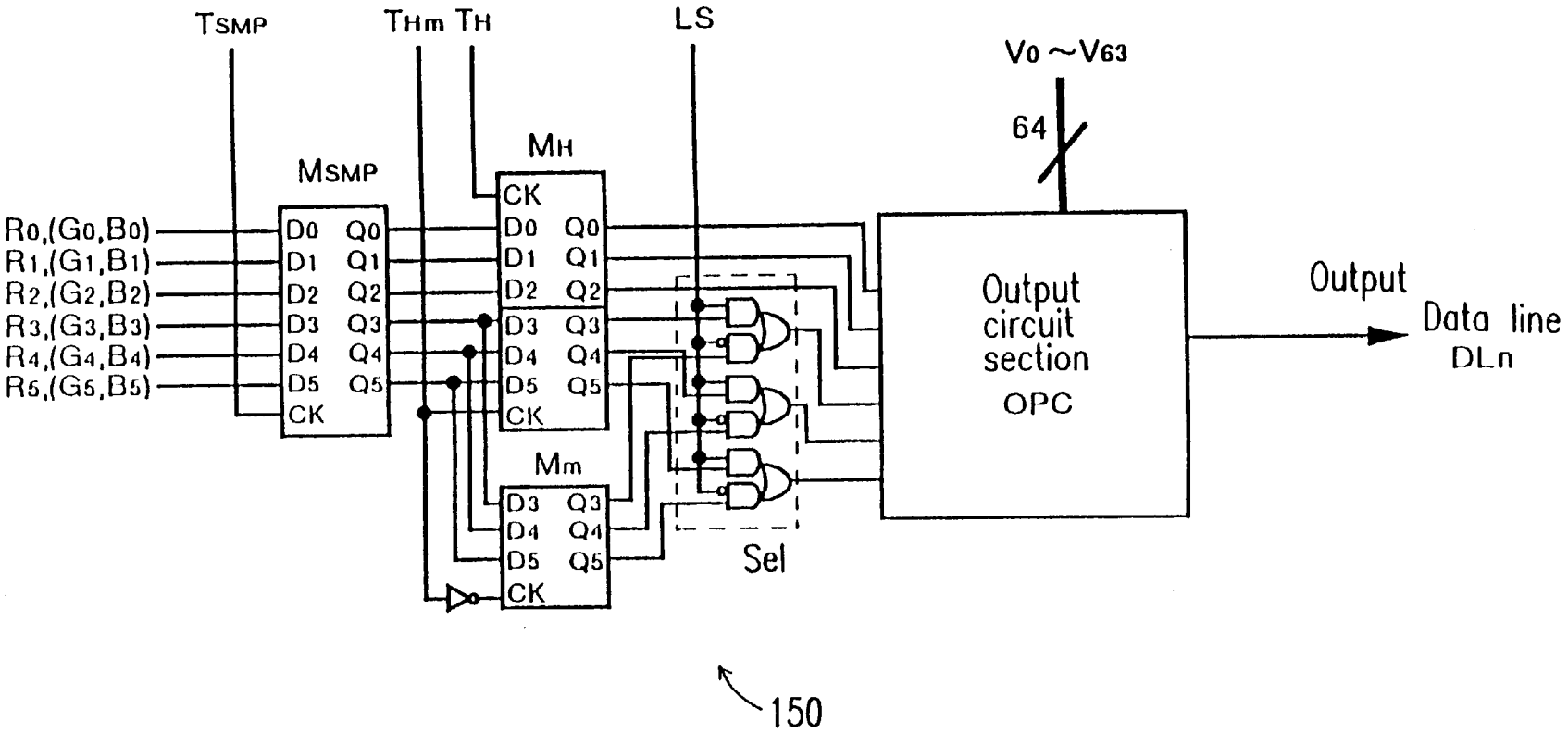
FIG. 15 is a circuit diagram showing a configuration of a circuit section (unit driver circuit 150) corresponding to one output of the six-bit digital driver of the present invention.

FIG. 15 shows a configuration of a circuit section (i.e., a unit driver circuit 150) corresponding to one output of a six-bit digital driver of the present invention. This unit driver circuit 150 is a variant of the unit driver circuit 110 shown in FIG. 11.

The unit driver circuit 150 is different from the unit driver circuit 110 in that the second holding memory $M_m$ of the unit driver circuit 150 is configured so as to hold only upper three bits of the six-bit image data, and in that the transfer pulse $T_H$ is input to the first holding memory $M_H$ of the unit driver circuit 150. If only the upper three bits are held, then an effect can be attained in that the second holding memory $M_m$ can be configured by a smaller number of elements. For example, assume that the second holding memory $M_m$ s made up of D flip-flops. In such a case, if the second holding memory $M_m$ is to hold six bits, the second holding memory $M_m$ requires six D flip-flops. In contrast, if the second holding memory $M_m$ is to hold three bits, the second holding memory $M_m$ requires only three D flip-flops.

Figure 16:
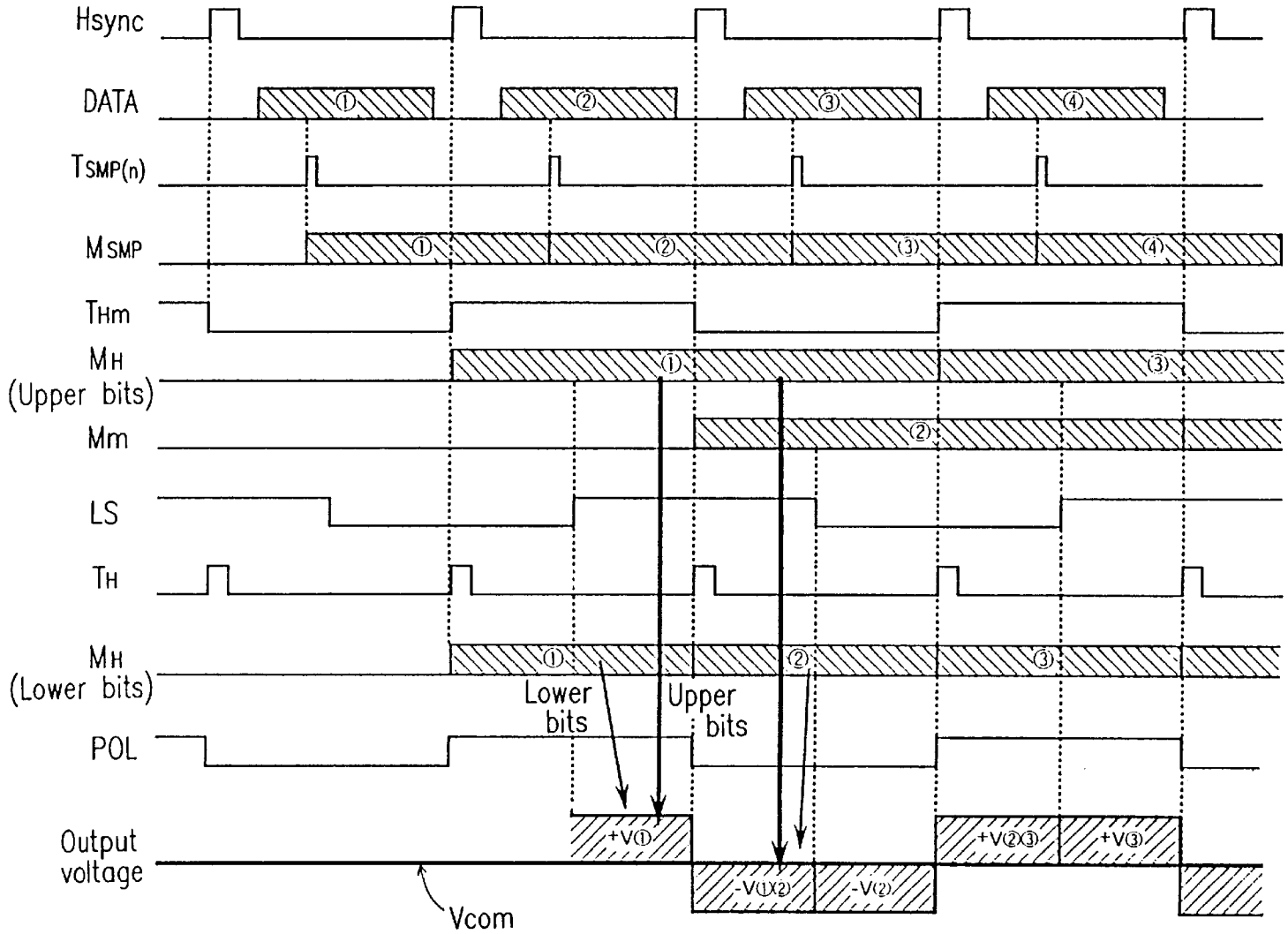
FIG. 16 is a timing diagram showing the waveforms of signals associated with the operation of the unit driver circuit 150 outputting a voltage to a data line $DL_n$.

FIG. 16 shows the waveforms of signals associated with the operation of the unit driver circuit 150 outputting a voltage to the data line $DL_n$ on the n-th column. Herein, n is an integer equal to or larger than 1 and equal to or smaller than N, and N represents the number of data lines.

In FIG. 16, DATA schematically shows the data input to the unit driver circuit 150 every horizontal interval. Hereinafter, the data input to the unit driver circuit 150 every horizontal interval will be denoted by Data ①, ②, ③, ④, . . . , etc.

Data ① is stored in the sampling memory $M_{SMP}$ in response to a sampling pulse $T_{SMP}(n)$ on the n-th column. The upper bits of Data ① stored in the sampling memory $M_{SMP}$ are transferred to the first holding memory $M_H$ in response to the leading edge of a transfer pulse $T_{Hm}$. On the other hand, the lower bits of Data ① stored in the sampling memory $M_{SMP}$ are transferred to first holding memory $M_H$ in response to a transfer pulse $T_H$. The first holding memory $M_H$ is selected by the selection circuit section Sel in response to an output pulse LS. The output circuit section OPC outputs a voltage (denoted by +V① in FIG. 16) corresponding to the upper bits of Data ① held in the first holding memory $M_H$ selected by the selection circuit section Sel and also corresponding to the lower bits of Data ① held in the first holding memory $M_H$ to the data line $DL_n$.

After the upper bits and the lower bits of Data ① have been transferred to the first holding memory $M_H$, Data ② is stored in the sampling memory $M_{SMP}$ in response to the sampling pulse $T_{SMP}(n)$. Thereafter, the upper bits of Data ② stored in the sampling memory $M_{SMP}$ are transferred to the second holding memory $M_m$ in response to the trailing edge of the transfer pulse $T_{Hm}$. On the other hand, the lower bits of Data ② stored in the sampling memory $M_{SMP}$ are transferred to the first holding memory $M_H$ in response to the transfer pulse $T_H$. While the first holding memory $M_H$ is selected by the selection circuit section Sel, the output circuit section OPC outputs a voltage (denoted by −V①② in FIG. 16) corresponding to the upper bits of Data ① held in the first holding memory $M_H$ selected by the selection circuit section Sel and also corresponding to the lower bits of Data ② held in the first holding memory $M_H$ to the data line $DL_n$. Thereafter, when the second holding memory $M_m$ is selected by the selection circuit section Sel in response to the output pulse LS, the output circuit section OPC outputs a voltage (denoted by −V② in FIG. 16) corresponding to the upper bits of Data ② held in the second holding memory $M_m$ selected by the selection circuit section Sel and also corresponding to the lower bits of Data ② held in the first holding memory $M_H$ to the data line $DL_n$.

After the upper bits of Data ② have been transferred to the second holding memory $M_m$ and the lower bits of Data ② have been transferred to the first holding memory $M_H$, Data ③ is stored in the sampling memory $M_{SMP}$ in response to the sampling pulse $T_{SMP}$(n). Thereafter, this procedure will be repeated.

In the example shown in FIG. 16, the transfer pulse $T_{Hm}$ is inverted every horizontal interval in synchronism the horizontal synchronizing signal Hsync. The output pulse LS is inverted every horizontal interval so as to be shifted from the transfer pulse $T_{Hm}$ by a predetermined phase. The predetermined phase shift may be equal to one fourth of one period of the transfer pulse $T_{Hm}$, for example. The transfer pulse $T_{Hm}$ is synchronous with the horizontal synchronizing signal Hsync, and is supplied to the first holding memory $M_H$ at the same time. In this manner, the upper bits are alternately stored in the first holding memory $M_H$ and the second holding memory $M_m$ every horizontal interval, and the upper bits stored in the first holding memory $M_H$ and the second holding memory $M_m$ are alternately output to the output circuit section OPC every horizontal interval.

A polarity signal POL is used for defining a positive drive time period and a negative drive time period. The positive drive time period and the negative drive time period alternate on a horizontal interval basis.

The output circuit section OPC outputs a voltage, which is positive with respect to a common electrode voltage $V_{COM}$, to the data line $DL_n$ during a positive drive time period, and outputs a voltage, which is negative with respect to the common electrode voltage $V_{COM}$, to the data line $DL_n$ during a negative drive time period.

In this way, in the first half of a horizontal interval, a negative output voltage −V①② in which the upper bits correspond to Data ① and the lower bits correspond to Data ② is output to the data line $DL_n$. In the second half of the horizontal interval, a negative output voltage −V② corresponding to Data ② is output to the data line $DL_n$. Subsequently, in the first half of the next horizontal interval, a positive output voltage +V②③ in which the upper bits correspond to Data ② and the lower bits correspond to Data ③ is output to the data line $DL_n$. In the second half of the horizontal interval, a positive output voltage +V③ corresponding to Data ③ is output to the data line $DL_n$. Thereafter, voltages are repeatedly output in this manner.

In this fourth example, the same output voltage waveform as that of the third example can be obtained. Thus, in the fourth example, the size of a unit driver circuit can be reduced without substantially deteriorating the display quality as compared with the second example.

In this example, the upper three bits of image data are assumed to be stored in the second holding memory $M_m$. However, the number of bits to be stored in the second holding memory $M_m$ is not limited to three. For example, one most significant bit (or two upper bits) of the image data may be stored in the second holding memory $M_m$. Alternatively, the upper four bits (or the upper five bits) of the image data may be stored in the second holding memory $M_m$. Furthermore, an arbitrary number of bits of the six-bit image data may be stored in the second holding memory $M_m$.

Moreover, since the first holding memory $M_H$ and the second holding memory $M_m$ are connected in parallel to the sampling memory $M_{SMP}$, the number of bits of the image data stored in the first holding memory $M_H$ may be reduced instead of reducing the number of bits of the image data stored in the second holding memory $M_m$.

Furthermore, the upper bits of data stored in the first holding memory $M_H$ are controlled in response to the transfer pulse $T_{Hm}$, while the lower bits of the data stored in the first holding memory $M_H$ are controlled in response to the transfer pulse $T_H$. In this way, the upper bits and the lower bits of the same data are controlled independently. Thus, a memory which is controlled in response to the transfer pulse $T_{Hm}$ to store the upper bits, and a memory which is controlled in response to the transfer pulse $T_H$ to store the lower bits may be used instead of the first holding memory $M_H$.

In the foregoing examples, a digital driver has been described. However, the principles of the present invention are also applicable to an analog driver.

As is apparent from the foregoing description, the present invention can prevent a display defect, resulting from the source-drain resistance and the capacitance of a TFT in a liquid crystal display panel because of the influence of the data line potential of the display panel on the potential (or charge) of a pixel electrode, from being generated. Consequently, the display quality of the panel can be considerably improved.

Furthermore, the size of a unit driver circuit can be reduced without substantially deteriorating the display quality. Consequently, the costs of the driver circuit can be reduced and the configuration thereof can be simplified.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for driving a display device including a display panel having a plurality of pixels and a plurality of data lines connected to the respective pixels, comprising the steps of:

sampling data in a first horizontal interval;

storing the data sampled in the first horizontal interval;

updating output data based on the stored data during sampling of a next data in a second horizontal interval immediately following the first horizontal interval, wherein the updated output data is based only on data sampled in the first horizontal interval; and outputting a voltage corresponding to the updated output data to a corresponding one of the data lines from a second half following a first half of the second horizontal interval to a first half of a third horizontal interval following the second horizontal interval, wherein inverse polarities are output to a corresponding one of the data lines in the second horizontal interval and in the third horizontal interval.

2. A circuit for driving a display device including a display panel having a plurality of pixels and a plurality of data lines connected to the respective pixels, comprising:

a sampling memory for storing data sampled in a first horizontal interval;

a transfer memory for storing data output from the sampling memory in response to a transfer pulse;

a holding memory for storing data output from the transfer memory in response to an output pulse, wherein the holding memory only holds data sampled from the first horizontal interval; and an output circuit section for outputting a voltage corresponding to the data stored in the holding memory to a corresponding one of the data lines, wherein the output pulse is supplied to the holding memory during sampling of a next data in a second horizontal interval immediately following the first horizontal interval, outputting a voltage corresponding to the updated output data to a corresponding one of the data lines from a second half following a first half of the second horizontal interval to a first half of a third horizontal interval following the second horizontal interval, wherein inverse polarities are output to a corresponding one of the data lines in the second horizontal interval and in the third horizontal interval.

3. A circuit according to claim 2, wherein the transfer pulse is supplied to the transfer memory after the sampling of the data has been completed in the first horizontal interval and before the sampling of the next data is started in the second horizontal interval.

4. A circuit according to claim 2, wherein the data stored in the transfer memory includes a first bit portion and a second bit portion, and wherein the holding memory stores the first bit portion of the data, and wherein the output circuit section outputs a voltage corresponding to the first bit portion of the data stored in the holding memory and also corresponding to the second bit portion of the data stored in the transfer memory to the data line.

5. A circuit for driving a display device including a display panel having a plurality of pixels and a plurality of data lines connected to the respective pixels, comprising:

a sampling memory for storing data sampled in a first horizontal interval;

a holding memory section including a first holding memory and a second holding memory, for storing data output from the sampling memory into one of the first holding memory and the second holding memory, in response to a transfer pulse;

a selection circuit section for selectively outputting one of the data stored in the first holding memory and the data stored in the second holding memory, in accordance with a level of an output pulse, wherein data selected by the selection circuit section is based only on data sampled in the first horizontal interval; and an output circuit section for outputting a voltage corresponding to the data selected by the selection circuit section to a corresponding one of the data lines, wherein the level of the output pulse changes during sampling of a next data in a second horizontal interval immediately following the first horizontal interval, outputting a voltage corresponding to the updated output data to a corresponding one of the data lines from a second half following a first half of the second horizontal interval to a first half of a third horizontal interval following the second horizontal interval, wherein inverse polarities are output to a corresponding one of the data lines in the second horizontal interval and in the third horizontal interval.

6. A circuit according to claim 5, wherein the level of the transfer pulse changes after the sampling of the data has been completed in the first horizontal interval and before the sampling of the next data is started in the second horizontal interval.

7. A circuit according to claim 5, wherein the data stored in the sampling memory includes a first bit portion and a second bit portion, and wherein the first holding memory stores the first bit portion and the second bit portion of the data, and wherein the second holding memory stores the first bit portion of the data, and wherein the selection circuit section selectively outputs one of the first bit portion stored in the first holding memory and the first bit portion stored in the second holding memory, and wherein the output circuit section outputs a voltage corresponding to the first bit portion of the data selected by the selection circuit section and also corresponding to the second bit portion of the data stored in the first holding memory to the data line.

8. The method as defined in claim 1, wherein said output data is updated at substantially a midpoint of said second horizontal interval.

9. The circuit according to claim 2, wherein the output pulse is supplied to the holding memory at substantially a midpoint of said second horizontal interval.

10. The circuit according to claim 5, wherein the level of the output pulse changes at substantially a midpoint of said second horizontal interval.

* * * * *